US005718183A

United States Patent [19]

Shimizu et al.

[11] Patent Number: 5,718,183

[45] Date of Patent: Feb. 17, 1998

[54] SEWING MACHINE

[75] Inventors: Masaki Shimizu, Toyoake; Akio Takahashi, Gifu-ken, both of Japan

[73] Assignee: Brother Kogyo Kabushiki Kaisha, Nagoya, Japan

[21] Appl. No.: 813,297

[22] Filed: Mar. 10, 1997

[30] Foreign Application Priority Data

Mar. 11, 1996 [JP] Japan ..... 8-083352
Mar. 13, 1996 [JP] Japan ..... 8-085917

[51] Int. Cl.[6] ..... D05B 19/14; D05B 69/24

[52] U.S. Cl. ..... 112/275; 112/220

[58] Field of Search ..... 112/275, 277, 112/220, 221, 155, 163, 300, 181, 470.01, 102.5

[56] References Cited

U.S. PATENT DOCUMENTS 4,674,421 6/1987 Iwase ..... 112/275 X
5,474,001 12/1995 Tajima et al. ..... 112/220 X
5,660,129 8/1997 Murata et al. ..... 112/220 X

FOREIGN PATENT DOCUMENTS 60-21750 5/1985 Japan .
3-234291 10/1991 Japan .

*Primary Examiner*—Peter Nerbun
*Attorney, Agent, or Firm*—Oliff & Berridge, P.L.C.

[57] ABSTRACT

A sewing machine including a needle bar for holding a sewing needle which conveys a sewing thread; a shaft member to which the needle bar is connected; a needle-bar drive motor which reciprocates the needle bar via the shaft member; a loop catcher which cooperates with the sewing needle to catch a loop of the sewing thread conveyed by the sewing needle; a catcher drive motor which rotates the loop catcher; an asynchronism detector which detects a first asynchronous state in which an amount of asynchronism between the needle bar and the loop catcher is greater than a first reference value and/or a second asynchronous state in which it is expected that the amount of asynchronism will be greater than a second reference value; and a holding device which holds, when the asynchronism detector detects the first and/or second asynchronous state, the needle bar and/or the loop catcher, at a holding position where the sewing needle and the loop catcher do not collide with each other.

20 Claims, 26 Drawing Sheets

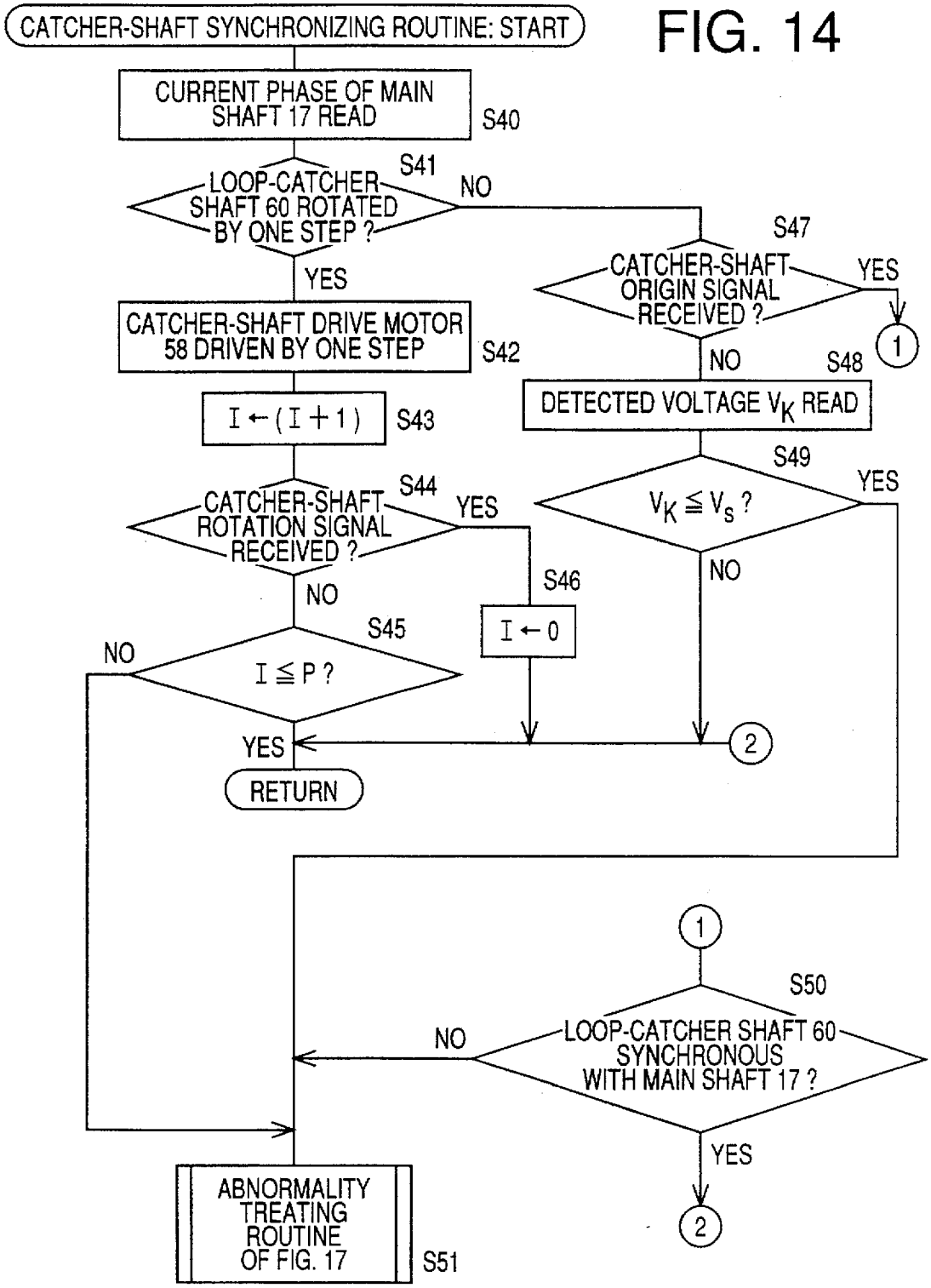
CATCHER-SHAFT SYNCHRONIZING ROUTINE: START
FIG. 14
CURRENT PHASE OF MAIN SHAFT 17 READ
S40
S41
LOOP-CATCHER SHAFT 60 ROTATED BY ONE STEP ?
NO
YES
CATCHER-SHAFT DRIVE MOTOR 58 DRIVEN BY ONE STEP
S42
I ← (I + 1)
S43
S44
CATCHER-SHAFT ROTATION SIGNAL RECEIVED ?
YES
NO
S45
I ≦ P ?
NO
YES
RETURN
S46
I ← 0
S47
CATCHER-SHAFT ORIGIN SIGNAL RECEIVED ?
YES
NO
1
S48
DETECTED VOLTAGE $V_K$ READ
S49
$V_K \leqq V_S$ ?
YES
NO
2
1
S50
LOOP-CATCHER SHAFT 60 SYNCHRONOUS WITH MAIN SHAFT 17 ?
NO
YES
2
ABNORMALITY TREATING ROUTINE OF FIG. 17
S51

SEWING MACHINE

BACKGROUND OF THE INVENTION

1. Field of the Invention

The present invention relates to a sewing machine in which a main shaft and a loop catcher are driven independently of each other.

2. Related Art Statement

There is known a sewing machine which is essentially provided by a sewing head, an arm portion, a column portion, and a sewing bed. A main shaft which is driven by a main motor is provided in the arm portion, and a needle bar and a take-up lever of the sewing head are driven or reciprocated by the driving force of the main shaft. A lower shaft and a loop catcher which cooperates with the sewing needle are provided in the sewing bed. The lower shaft is also driven or rotated by the driving force obtained from the main shaft. Thus, the loop catcher is rotated in synchronism with the reciprocation of the sewing needle.

If the sewing machine is provided with an exclusive drive motor which drives the loop catcher independent of the main shaft, the instantaneous rotating state of the loop catcher can be controlled depending upon given sewing conditions, while the rotation of the loop catcher is synchronized with the rotation of the main shaft.

For example, Japanese Patent Application laid open for opposition under Publication No. 60 (1985)-21750 discloses a sewing machine including a needle drive motor for driving a sewing needle and a loop-catcher drive motor for driving a loop catcher. In this sewing machine, the two motors are controlled to synchronize the sewing needle and the loop catcher with each other and thereby form a series of perfect stitches.

In addition, Japanese Patent Application laid open for inspection under Publication No. 3 (1991)-234291 discloses a sewing machine including a needle drive motor for driving a sewing needle via a main shaft, and a loop-catcher drive motor for driving a loop catcher independent of the main shaft. A rotary encoder detects the amount of rotation of the main shaft and, when the main shaft is manually rotated by a user, the loop-catcher drive motor is rotated by the same amount as that of the main shaft, by a synchronizing device. Thus, the sewing needle and the loop catcher are operated while the synchronism of the two elements is maintained by the synchronizing device.

Moreover, U.S. Pat. No. 5,474,001 discloses a multiple-head embroidering machine in which a needle-bar driving device, a take-up-lever driving device, a presser-foot driving device, and a loop-catcher driving device are driven independent of one another so as to provide a variety of embroideries.

Thus, in the art of driving a main shaft and a loop catcher independent of each other, there have been various proposals to keep the synchronization of a sewing needle and the loop catcher. However, there have been no proposals to provide the art of detecting the amount of asynchronism between the two elements during a sewing operation, to provide the countermeasure of treating an asynchronous state in which the amount of asynchronism between the two elements is greater than a permissible value, or the countermeasure of treating another asynchronous state in which it is expected that the amount of asynchronism will be greater than a permissible value.

When the synchronism between the sewing needle and the loop catcher breaks and the amount of asynchronism between the two elements becomes greater than a permissible value, the sewing needle may collide with the loop catcher and may break due to the collision. When an electric voltage being supplied to the main motor and/or the loop-catcher drive motor falls more than a predetermined amount, the respective rotation speeds of the two motors change differently from each other and accordingly it is expected that the amount of asynchronism between the needle and the catcher will be greater than a reference value. Similarly, when an electricity (electric power) supplying service interrupts, the two motors will stop after rotating due to respective inertias and accordingly it is expected that the amount of asynchronism between the needle and the catcher will be greater than a reference value. In each case, the sewing needle may collide with the loop catcher.

SUMMARY OF THE INVENTION

It is therefore an object of the present invention to provide a sewing machine which is free from at least one of the above-identified problems.

According to the present invention, there is provided a sewing machine comprising a needle bar for holding a sewing needle which conveys a sewing thread, a shaft member to which the needle bar is connected, a needle-bar drive motor which reciprocates the needle bar via the shaft member, a loop catcher which cooperates with the sewing needle to catch a loop of the sewing thread conveyed by the sewing needle, a catcher drive motor which rotates the loop catcher, an asynchronism detector which detects at least one of a first asynchronous state in which an amount of asynchronism between the needle bar and the loop catcher is greater than a first reference value and a second asynchronous state in which it is expected that the amount of asynchronism will be greater than a second reference value, and a holding device which holds, when the asynchronism detector detects the at least one of the first and second asynchronous states, at least one of the needle bar and the loop catcher, at a holding position where the sewing needle and the loop catcher do not collide with each other. The first and second reference values may, or may not, be equal to each other.

In the sewing machine constructed as described above, since the loop catcher is driven by the catcher drive motor independent of the needle-bar drive motor, an excessive amount of asynchronism may occur between the needle bar and the loop catcher. For example, in the case where the catcher drive motor is provided by a stepper motor, such asynchronism may occur due to stepping-out of the stepper motor. In such cases, the sewing needle may collide with the loop catcher and may break due to the collision. Therefore, when the asynchronism detector detects the first and/or second asynchronous state, the holding device holds the needle bar or the loop catcher, at a holding position where the sewing needle and the loop catcher (e.g., point-of-hook of the catcher) do not collide with each other. The holding position may be the upper-dead position of the needle bar. Thus, the sewing needle is effectively prevented from colliding with the loop catcher due to the excessive amount of asynchronism between the needle bar and the loop catcher. The holding device may be adapted to hold the loop catcher at a position away from the sewing needle.

According to a preferred feature of the present invention, the asynchronism detector comprises a first asynchronous state detector which detects the first asynchronous state.

According to another feature of the present invention, the first asynchronous state detector comprises a phase difference depending detector which obtains, as the amount of asynchronism, a phase difference between a nominal phase of one of the needle bar and the loop catcher which corresponds to a reference phase of the other of the needle bar and the catcher and an actual phase of the one of the needle bar and the catcher when the other of the needle and the catcher actually takes the reference phase, and which detects the first asynchronous state when the phase difference is greater than the first reference value. Otherwise, a ratio of the actual phase to the nominal phase may be used to detect the first asynchronous state.

According to another feature of the present invention, the phase difference depending detector comprises a reference phase detector which detects the reference phase of the other of the needle bar and the loop catcher, and an actual phase detector which detects the actual phase of the one of the needle bar and the catcher when the reference phase detector detects the reference phase of the other of the needle bar and the catcher.

According to another feature of the present invention, the phase difference depending detector comprises the actual phase detector comprising a rotation amount detector which detects, as the actual phase, an amount of rotation of the shaft member from a first predetermined phase thereof during a time period in which the loop catcher is actually rotated from a second predetermined phase thereof corresponding to the first predetermined phase of the shaft member, to a third predetermined phase as the reference phase, calculating means for calculating, based on the amount of rotation of the shaft member, an actual command signal number representing a number of command signals which are actually supplied to a stepper motor as the catcher drive motor during the time period, each of the command signals being supplied to the stepper motor to rotate the shaft member by a predetermined amount, and judging means for judging whether a difference between the actual command signal number and a nominal command signal number representing, as the nominal phase, a number of command signals which are nominally supplied to the stepper motor while the loop catcher is rotated from the second predetermined phase to the third predetermined phase, is greater than a reference command signal number representing the first reference value.

According to another feature of the present invention, the phase difference depending detector further comprises a memory in which at least one of the nominal command signal number and the reference command signal number is stored.

According to another feature of the present invention, the asynchronism detector comprises a second asynchronous state detector which detects the second asynchronous state.

According to another feature of the present invention, the second asynchronous state detector comprises a commanding device which supplies a command signal to a stepper motor as the catcher drive motor to rotate the stepper motor and the loop catcher, a catcher rotation detector which detects the rotation of the loop catcher by the stepper motor in response to the command signal supplied thereto from the commanding device, a command signal counter which counts a number of command signals which are actually supplied from the commanding device to the stepper motor, and judging means for judging that the amount of asynchronism will be greater than the second reference value, when the catcher rotation detector does not detect more than a predetermined amount of rotation of the loop catcher by the stepper motor in response to the number of command signals supplied thereto from the commanding device.

According to another feature of the present invention, the judging means comprises means for judging that the amount of asynchronism will be greater than the second reference value, when the catcher rotation detector does not detect any amount of rotation of the loop catcher in response to the number of command signals supplied thereto from the commanding device.

According to another feature of the present invention, the second asynchronous state detector comprises a voltage fall detector which detects that an electric voltage which is supplied to at least one of the needle-bar drive motor and the catcher drive motor has fallen to a value at which the least one of the needle-bar drive motor and the catcher drive motor does not normally operate. When the electric voltage being supplied to the needle-bar drive motor and/or the catcher drive motor falls to the reference value, the needle-bar drive motor and/or the catcher drive motor does not normally operate. That is, the respective rotation speeds of the two motors lower and the synchronism between the two motors will break. Therefore, when the voltage fall detector detects that the electric voltage has fallen to the reference value, the holding device holds the needle bar or the loop catcher at the holding position. Thus, the sewing needle is effectively prevented from colliding with the loop catcher. Otherwise, the voltage fall detector may be modified to identify the second asynchronous state, by detecting an excessive amount of voltage fall in a predetermined time duration.

According to another feature of the present invention, the second asynchronous state detector comprises a service-interruption detector which detects that a service of an electricity to at least one of the needle-bar drive motor and the catcher drive motor has interrupted. When an electricity supplying service interrupts, the needle-bar drive motor and the catcher drive motor will rotate differently from each other due to their inertias and it is expected that the amount of asynchronism between the needle bar and the loop catcher will be greater than the second reference value. Therefore, when the service-interruption detector detects that the electricity supplying service has interrupted, the holding device holds the needle bar or the loop catcher at the holding position. Thus, the sewing needle is effectively prevented from colliding with the loop catcher.

According to another feature of the present invention, the sewing machine further comprises a control device which operates, when the asynchronism detector detects the at least one of the first and second asynchronous states, the holding device to hold the one of the sewing needle and the loop catcher at the holding position.

According to another feature of the present invention, the holding device comprises a needle-bar holding device which holds the sewing needle at the holding position where the sewing needle does not collide with the loop catcher.

According to another feature of the present invention, the needle-bar holding device comprises a needle-bar jumping mechanism comprising a biasing member which provides a biasing force to bias the needle bar toward an upper dead position thereof, and a needle-bar disconnecting device which disconnects the needle bar from the shaft member and permits the needle bar to jump up to the upper dead position thereof because of the biasing force of the biasing member.

According to another feature of the present invention, the disconnecting device comprises an axis member which extends in a direction in which the needle bar is reciprocated, a drive member which is supported by the axis member such that the drive member is movable relative to the axis member in an axial direction thereof and is rotatable about the axis member relative thereto, an engageable member which is provided on the needle bar and is engageable with the drive member, a biasing member which provides a biasing force to bias the drive member and thereby rotate the drive member toward an engageable rotation position at which the drive member is engageable with the engageable member, and a connection member which is connected to the shaft member such that the connection member is moved relative to the axis member in the axial direction thereof, by the needle-bar drive motor via the shaft member, and which is connected to the drive member such that the drive member is movable with the connection member in the axial direction of the axis member and is rotatable about the axis member relative to the connection member.

According to another feature of the present invention, the needle-bar jumping mechanism further comprises an actuator which rotates the drive member from the engageable rotation position at which the drive member is engaged with the engageable member provided on the needle bar, to a non-engageable rotation position at which the drive member is not engageable with the engageable portion, so that the needle bar jumps up to the upper dead position thereof because of the biasing force of the biasing member.

According to another feature of the present invention, the drive member has an inclined upper surface and an engageable recess, and wherein when the drive member being held in the engageable rotation position is moved up to a position corresponding to the upper dead position of the needle bar, by the needle-bar drive motor via the shaft member and the connection member, the drive member is rotated from the engageable position toward the non-engageable rotation position, against the biasing force of the biasing member, because the inclined surface of the drive member is engaged with the engageable member provided on the needle bar, and, when the drive member reaches the position corresponding to the upper dead position of the needle bar, the engageable recess is permitted to engage the engageable member, and the drive member is permitted to rotate because of the biasing force of the biasing member, from the non-engageable position to the engageable position at which the engageable recess of the drive member is engaged with the engageable member.

According to another feature of the present invention, the sewing machine further comprises a converting mechanism which converts the rotation of the shaft member by the needle-bar drive motor, into the movement of the connection member and the drive member relative to the axis member in the axial direction thereof.

According to another feature of the present invention, the sewing machine further comprises an electric source, wherein the holding device comprises an electrically-operated actuator which is, when the asynchronism detector detects the at least one of the first and second asynchronous states, supplied with an electricity from the electric source so as to hold the one of the needle bar and the loop catcher at the holding position. For example, the electric source may immediately supply the stored electricity to an actuator of the holding device, so that the actuator may quickly and reliably operate for holding the needle bar or the loop catcher at the holding position. Thus, the sewing needle is effectively prevented from colliding with the loop catcher.

According to another feature of the present invention, the electric source comprises a capacitor which stores the electricity.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 14 is a flow chart representing a catcher-shaft synchronizing routine;

DETAILED DESCRIPTION OF THE PREFERRED EMBODIMENTS

Figure 1:
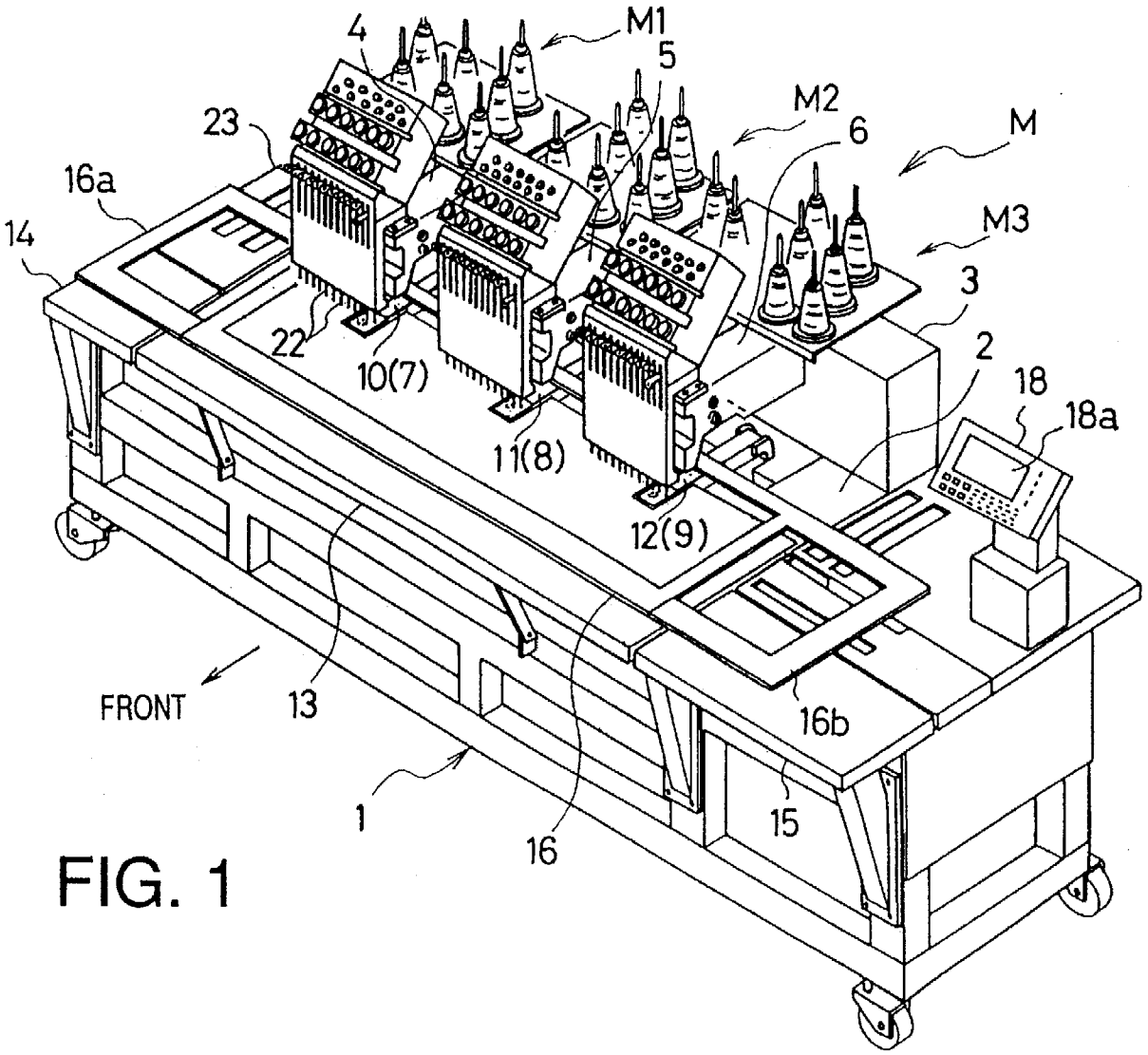
FIG. 1 is a perspective view of a multiple-head embroidering machine to which the present invention is applied.

FIG. 1 shows a multiple-head embroidering machine, M, to which the present invention is applied. The embroidering machine M includes three multiple-needle sewing machines, M1, M2, M3. Each sewing machine M1–M3 includes a loop catcher 59 in the form of a full-rotation shuttle (FIG. 4) which catches a loop of a needle thread 47 conveyed by a sewing needle 22 (FIG. 2), and a loop-catcher drive motor 58 (FIG. 4) which drives or rotates a loop-catcher shaft 59*a* of the loop catcher 59 and which is independent of a main motor 110 (FIG. 8) which drives or rotates a main shaft 17 (FIG. 2) and thereby reciprocates the needle 22.

As shown in FIG. 1, the embroidering machine M includes an elongate base frame 1. A support plate 2 is provided on a rear portion of the base frame 1. The support plate 2 has a predetermined length in the longitudinal direction of the base frame 1, and has a generally rectangular shape in its plan view. An elongate support frame 3 stands on a rear portion of the support plate 2, and supports three sewing heads 4, 5, 6 such that the three sewing heads 4–6 are equidistant from one another in the longitudinal direction of the support frame 3. Respective end portions of three sewing beds 7, 8, 9 in the form of three, generally cylindrical bed units 10, 11, 12 which correspond to the three sewing heads 4–6, respectively, are supported by an elongate portion of the base frame 1 which corresponds to a front end portion of the support plate 2.

Thus, the three multiple-needle sewing machines M1–M3 are provided by the three sewing heads 4–6 supported by the support frame 3, and the three bed units 10–12 which are independent of one another, respectively. A front end portion of the sewing head 4–6 of each sewing machine M1–M3 supports twelve needle bars 21 (FIG. 2) which are arranged in an array extending in the longitudinal direction of the base frame 1, such that one of the needle bars 21 which is positioned or indexed at an operating position is reciprocated up and down by the main motor 110 via the main shaft 17. Each sewing head 4–6 additionally has twelve take-up levers 23 which correspond to the twelve needle bars 21, respectively, and one of the twelve take-up levers 23 which corresponds to the said one needle bar 21 being positioned at the operating position is swung in synchronism with the reciprocation of the said one needle bar 21. The needle bars 21 and the take-up levers 23 are accommodated in a needle-bar case 20, which is supported by each sewing head 4–6 such that the needle-bar case 20 is movable in the longitudinal direction of the base frame 1. The respective needle-bar cases 20 of the three sewing heads 4–6 can be moved, simultaneously with one another, by a needle-bar changing device (not shown) which is driven by a needle-bar changing motor 115 (FIG. 8), so that color sewing threads 47 conveyed by a current group of sewing needles 22 being positioned at the respective operating positions are changed to different color sewing threads 47 conveyed by a new group of sewing needles 22.

A work table 13 is provided in front of the support plate 2 such that an upper surface of the work table 13 is flush with those of the bed units 10–12 and extends horizontally. An elongate movable frame 16 which extends in the longitudinal direction of the base frame 1 and has a rectangular shape in its plan view, is placed over the work table 13 and a pair of side tables 14, 15 which are provided on both sides of the work table 13, respectively.

One 16*b* of opposite end portions 16*a*, 16*b* of the movable frame 16 is driven or moved by an X-axis moving device (not shown) in an X-axis direction, i.e., in the longitudinal direction of the base frame 1, and the two end portions 16*a*, 16*b* are driven or moved by a Y-axis moving device (not shown) in a Y-axis direction perpendicular to the X-axis direction. The X-axis and Y-axis moving devices include an X-axis driving motor 117 and a Y-axis driving motor 119 (FIG. 8), respectively. Thus, the movable frame 16 is movable to an arbitrary position on an X-Y plane defined by the X-axis and Y-axis directions. An operator's panel 18 including a display 18*a* is provided on a rear portion of the side table 15. The display 18*a* displays various messages relating to a sewing operation. The operator's panel 18 is operable for inputting various commands into the embroidering machine M.

Figure 2:
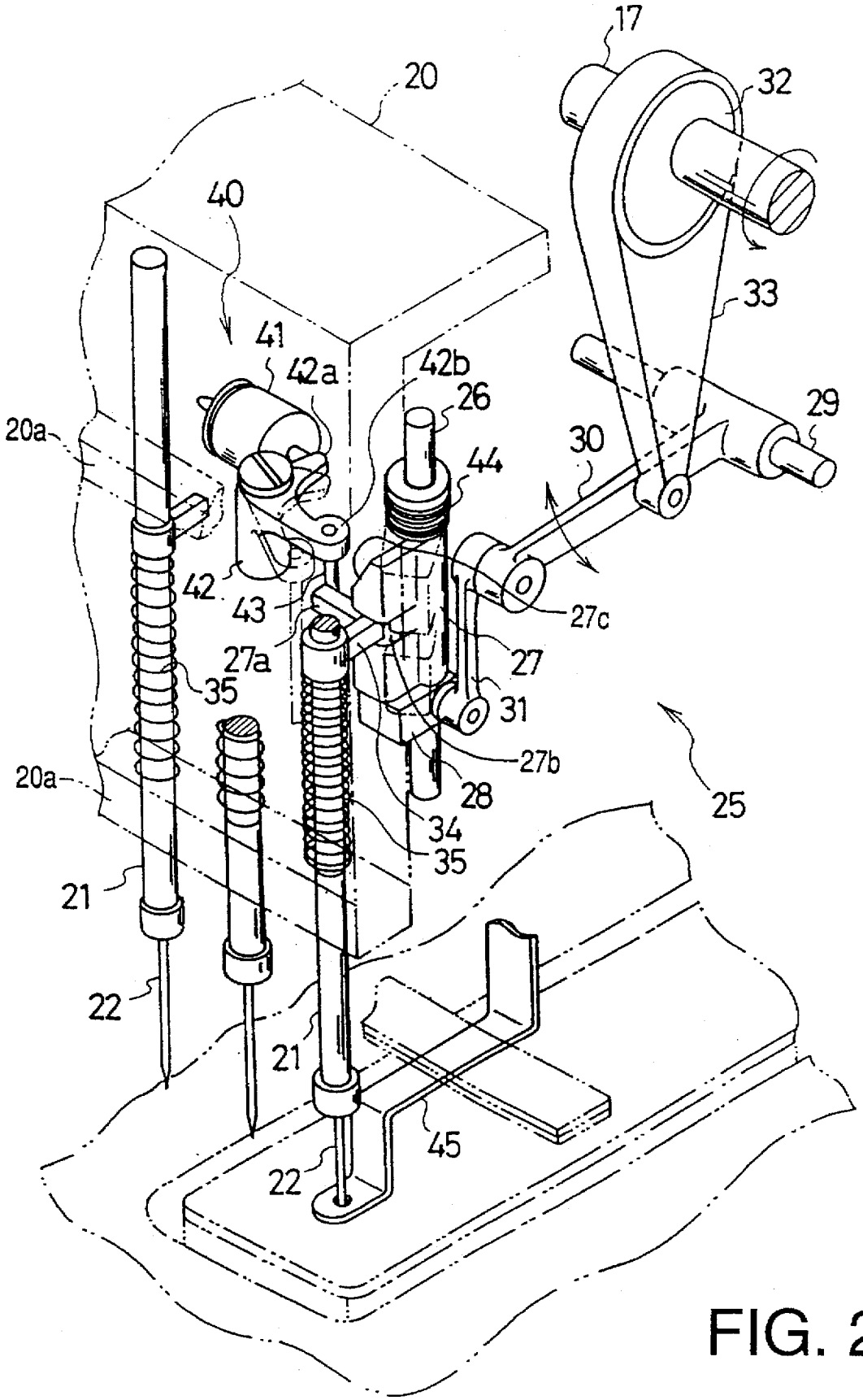
FIG. 2 is a perspective view of a needle-bar reciprocating device including a needle-bar jumping device.

Referring next to FIG. 2, there will be described a needle-bar drive device 25 which is employed by each sewing machine M1–M3 and which drives or reciprocates the needle bar 21 up and down.

The needle-bar drive device 25 includes an axis member 26 which vertically extends inside a front end portion of each sewing head 4–6. An upper and a lower end portion of the axis member 26 are supported by a main frame of each sewing head 4–6. A drive member 27 is fit on the axis member 26 such that the drive member 27 is movable relative to the axis member 26 vertically, i.e., in an axial direction of the same 26. The drive member 27 has an engageable recess 27*b* which is engageable with an engageable pin 34 which is fixed to the needle bar 21. A connection member 28 is fit on the axis member 26 such that the connection member 28 is vertically movable relative to the axis member 26 but is not rotatable relative to the same 26. A lower end portion of the drive member 27 is connected to an upper end portion of the connection member 28 such that the drive member 27 is vertically movable with the connection member 28 and is rotatable relative to the connection member 28 about the axis member 26. The connection member 28 is connected to a link member 31 which in turn is pivotally connected to a pivot lever 30 which is pivotally supported by a pivot axis member 29 fixed to the main frame of each sewing head 4–6.

A single main shaft 17 extends in the X-axis direction through the sewing heads 4–6. An eccentric cam 32 is fixed to the main shaft 17, and a lower end portion of an eccentric lever 33 which is externally fit on the eccentric cam 32 is pivotally connected to the pivot lever 30.

A sewing needle 22 is secured to a lower end of each of the twelve needle bars 21 of each sewing head 4–6. The engageable pin 34 is fixed to an intermediate position of each needle bar 21. A compression coil spring 35 is provided around an intermediate portion of the bar 21 between the engageable pin 34 and a lower support member 20*a* of the needle-bar case 20. The coil spring 35 biases the bar 21 toward an upper-dead position thereof, i.e., toward an upper support member 20*a*. When the needle-bar case 20 is moved in the X-axis direction, the engageable pin 34 of the needle bar 21 being positioned or indexed at the operating position is engaged with the engageable recess 27*b* of the drive member 27 being held at its upper-dead position corresponding to the upper-dead position of the needle bar 21.

When a main motor 110 (FIG. 8) is driven or rotated in a predetermined direction, the main shaft 17 is rotated in a corresponding direction. The rotation of the main shaft 17 is converted by a converting device including the eccentric lever 33, the pivot lever 30, and the link member 31, into the reciprocal movement of the drive member 27 and the connection member 28 as a unit on the axis member 26. Thus, only the needle bar 21 that is connected to the drive member 27 via the engageable pin 34 and the engageable recess 27b is reciprocated up and down in synchronism with the rotation of the main shaft 17.

Next, there will be described a needle-bar jumping device 40 which is employed in each sewing machine M1–M3 and which jumps the needle bar 21 up to the upper-dead position thereof.

As shown in FIG. 2, a needle-bar jumping solenoid 41 which has a horizontal plunger is provided in the needle-bar case 20. A rotatable lever 42 which has two arms 42*a*, 42*b* is supported by the needle-bar case 20, such that the lever 42 is rotatable about a vertical axis line. One 42*a* of the two arms 42*a*, 42*b* of the lever 42 is held in contact with the plunger of the solenoid 41. An operative member 43 is fixed to the other arm 42*b* of the lever 42, such that the operative member 43 vertically extends and is engageable with an engageable projection 27*a* which is formed as an integral part of the drive member 27 and projects from the same 27.

A coil spring 44 which is provided above the drive member 27 elastically biases the drive member 27 to rotate in a direction from a non-engageable rotation position, indicated in phantom line, where the drive member 27 cannot engage the engageable pin 34, toward an engageable rotation position, indicated in solid line, where the drive member 27 can engage the engageable pin 34.

When the needle-bar jumping solenoid 41 is energized for a predetermined time duration, with the drive member being engaged with the pin 34 of the needle bar 21, the plunger of the solenoid 41 is advanced to rotate the lever 42 in a clockwise direction in its plan view. The rotation of the lever 42 is transmitted to the drive member 27 via the axis member 43 and the projection 27*a*, so that the drive member 27 is rotated against the biasing force of the coil spring 44 from the engageable position to the non-engageable position where the recess 27*b* is disengaged from the pin 34 and the needle bar 21 is permitted to jump up to the upper-dead position because of the biasing force of the coil spring 25.

When the drive member 27 is moved up toward its upper-dead position with the needle bar 21 being held at its upper-dead position after jumping up and with the drive member 27 being held at its engageable position after returning, an inclined upper surface 27*c* of the drive member 27 is engaged with a lower surface of the pin 34, so that the drive member 27 is permitted to rotate to the non-engageable position against the biasing force of the coil spring 44. However, since subsequently the pin 34 engages the recess 27*b*, the drive member 27 is rotated toward the engageable position because of the biasing action of the spring 44. Thus, the drive member 27 and the needle bar 21 are automatically engaged with each other at their upper-dead positions.

Figure 8:
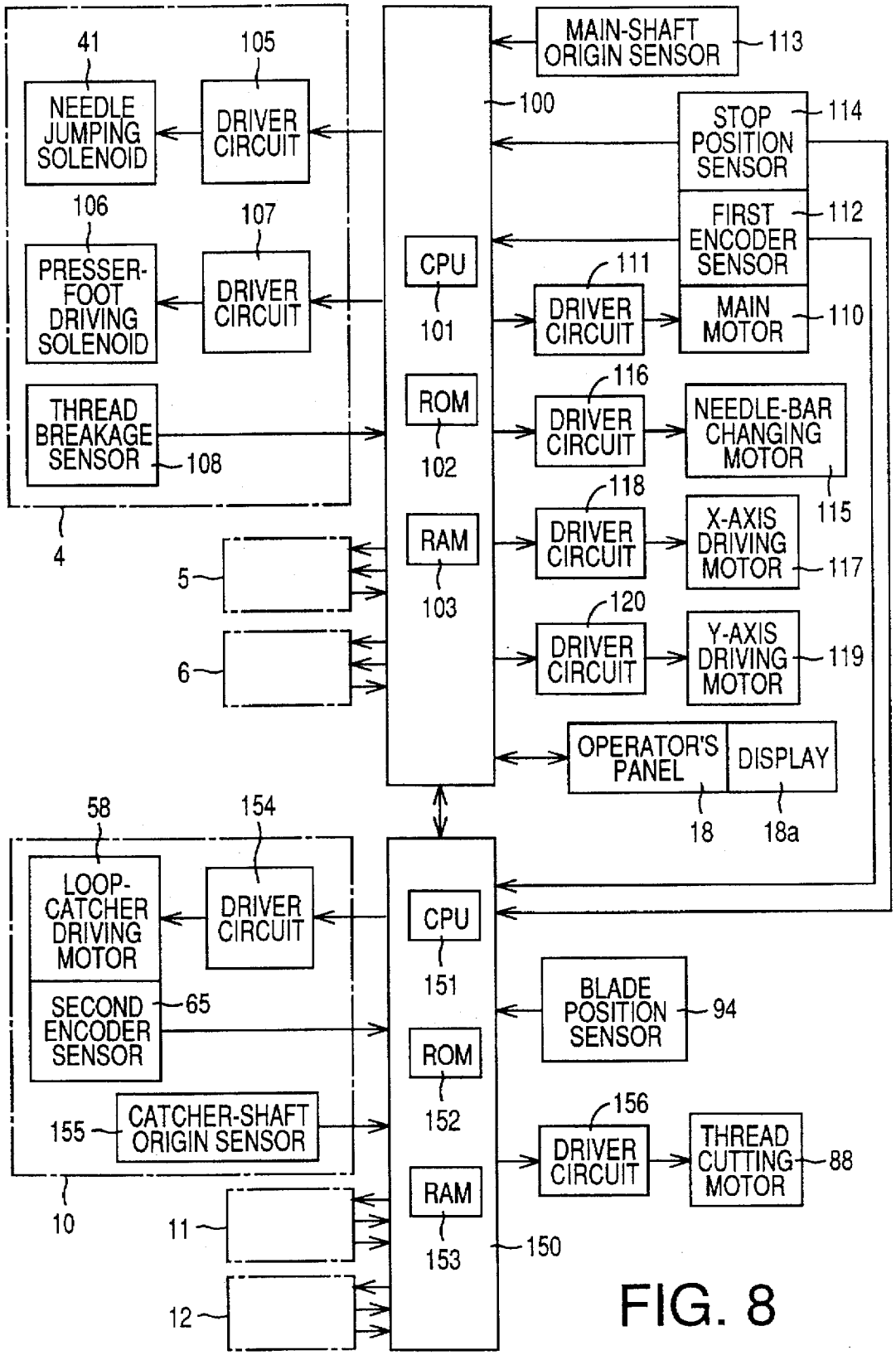
FIG. 8 is a block diagram of an electronic construction of the multiple-head embroidering machine of FIG. 1.

Each sewing bed 7–9 includes a presser foot 45 which is selectively moved to an operating position where the foot 45 presses a work sheet, W, held by the movable frame 16 above the bed 7–9, and a retracted position higher than the operating position by a predetermined distance. The presser foot 45 is moved by a presser-foot moving device (not shown) which is driven by a presser-foot driving solenoid 108 (FIG. 8).

Referring next to FIGS. 3 to 7, there will be described the bed units 10–12. Since the three bed units 10–12 have the same construction, one 10 of the three units 10–12 will be described.

The bed unit 10 includes a bed case 50 which extends in the Y-axis direction and which has a generally U-shaped cross section. A rear end portion of the bed case 50 is attached to a pair of support brackets 51 which are fixed to the elongate portion of the base frame 1 which corresponds to the front end portion of the support plate 2 and which extends in the X-axis direction. A loop-catcher module 55 is detachably attached to a front end portion of the bed case 50. An upper side of the front end portion of the bed case 50 is covered by a throat plate 52 having a needle throat 52*a*, and a cover plate 53 provided adjacent to the throat plate 52.

Next, the loop-catcher module 55 will be described in detail.

Figure 4:
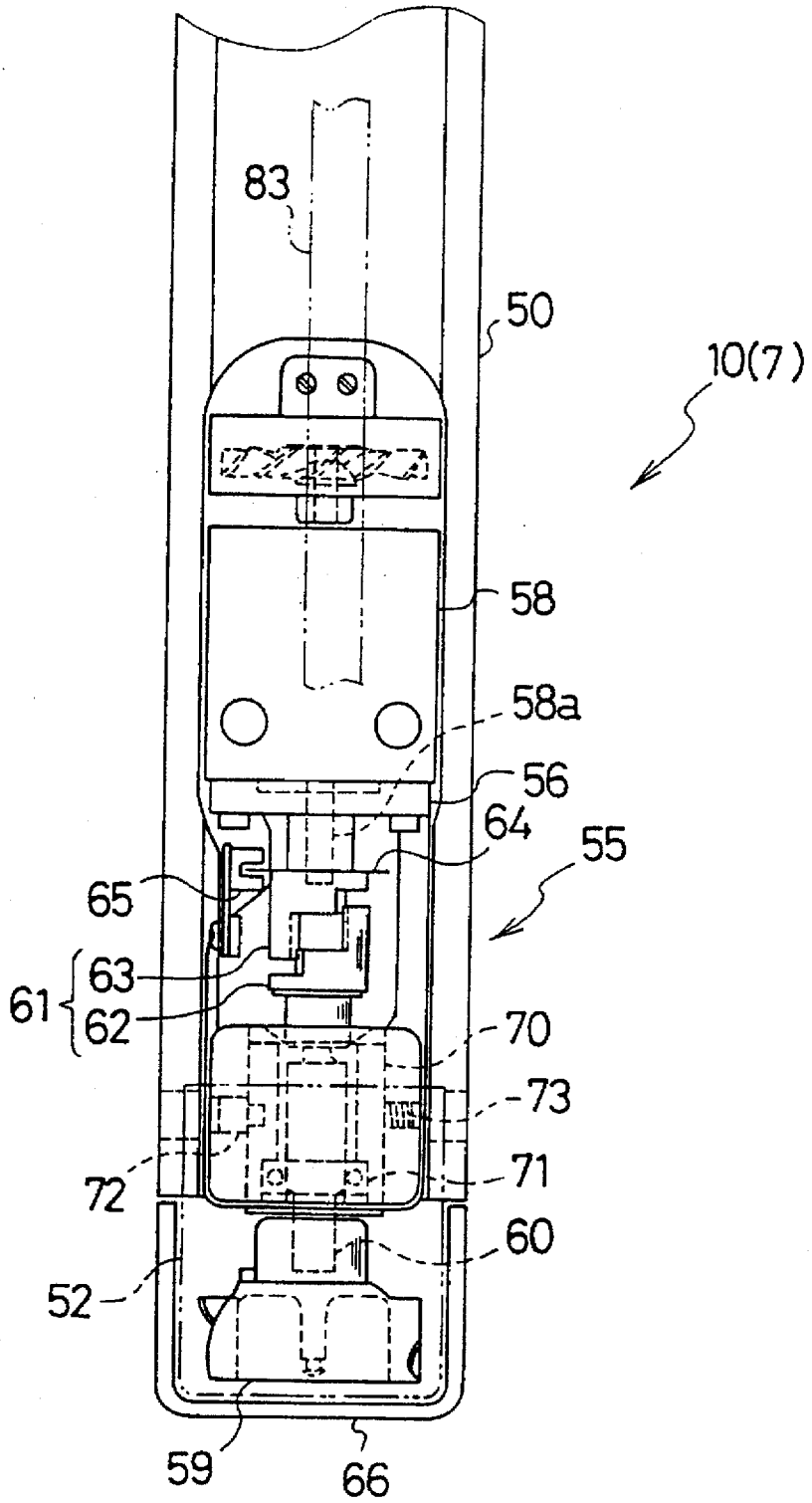
FIG. 4 is a plan view of a part of the bed unit which includes a loop-catcher module.
Figure 5:
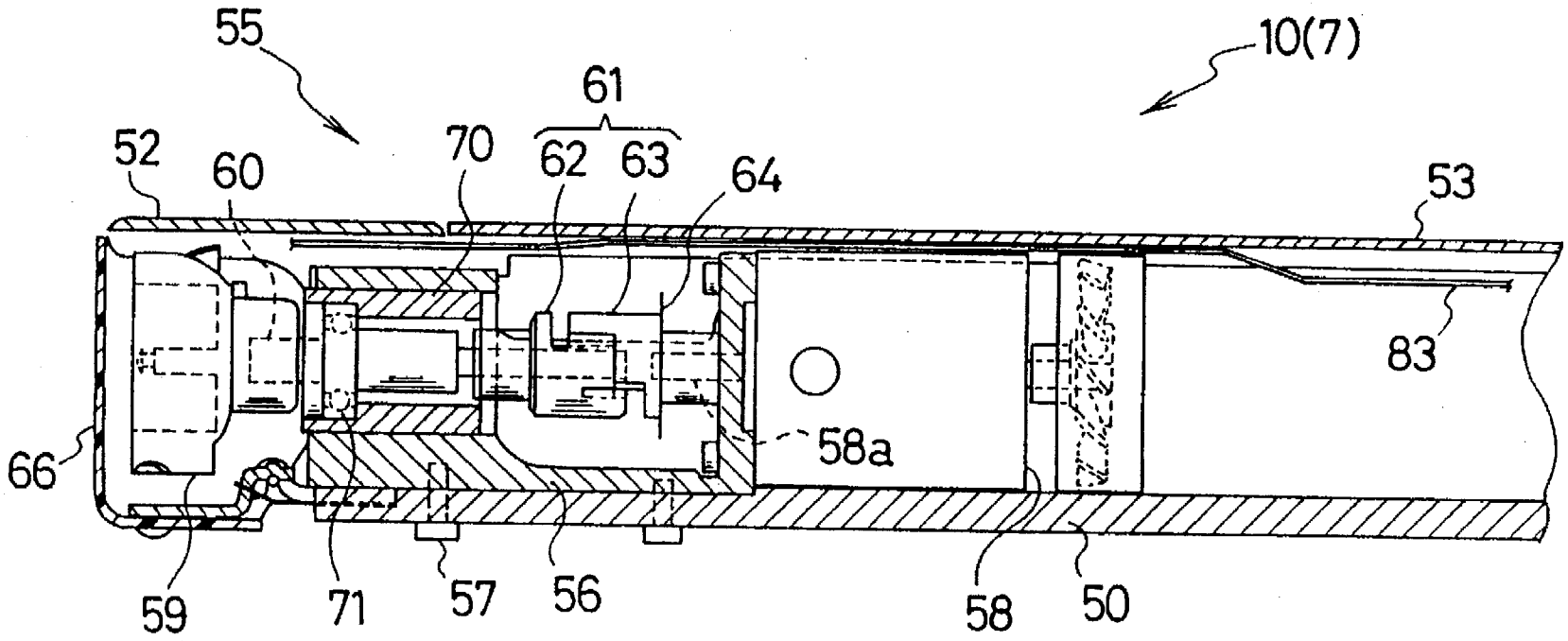
FIG. 5 is a longitudinal, cross section view of the part of the bed unit including the loop-catcher module.
Figure 6:
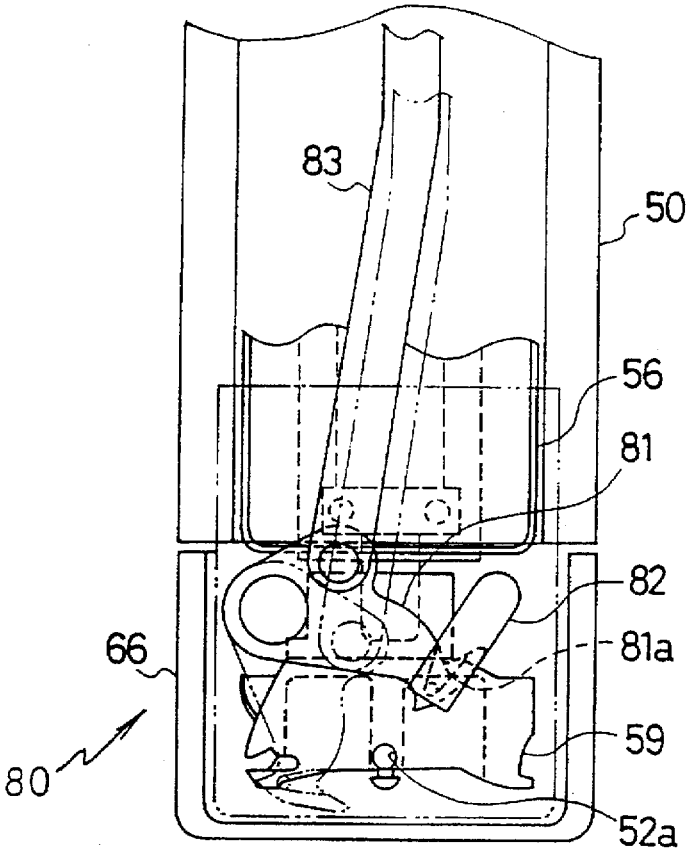
FIG. 6 is an enlarged plan view of a front end portion of the bed unit.

As shown in FIGS. 4 and 5, an attachment block 56 is attached, with a vis 57, to the front end portion of the bed case 50, and a loop-catcher drive motor 58 which is provided by a stepper motor is fixed to a rear end of the block 56. The loop catcher 59 which is provided by a full-rotation shuttle is disposed in front of the block 56, and a loop-catcher shaft 60 which is fixed to the loop catcher 59 is supported by the block 56 such that the catcher shaft 60 is rotatable about an axis line thereof and such that the shaft 60 is movable in the Y-axis direction, that is, the position of the shaft 60 is adjustable in the Y-axis direction. A first connection member 62 is fixed to a rear end of the catcher shaft 60, and a second connection member 63 is fixed to a front end of a drive shaft 58*a* of the catcher drive motor 58. The first and second connection members 62, 63 are connected to each other to provide a coupling or connecting device 61. Thus, the coupling device 61 connects between the catcher shaft 60 and the drive shaft 58*a* of the catcher drive motor 58.

Figure 21:
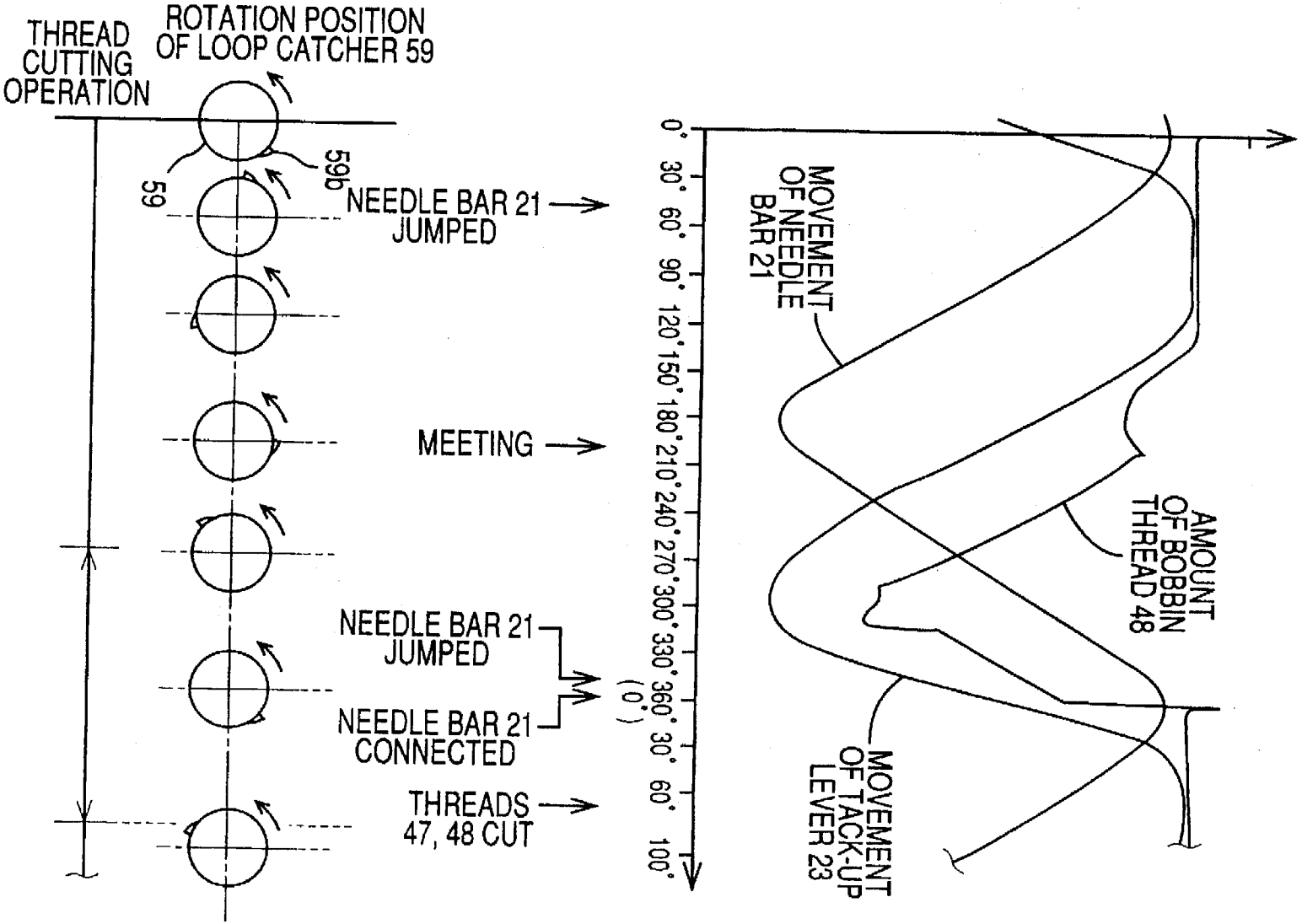
FIG. 21 is a time chart illustrating three curves representing the movement of a needle bar, the movement of a take-up lever, the amount of a bobbin thread, and the rotation position of a loop catcher, in comparison with the rotation position of a main shaft.
Figure 23:
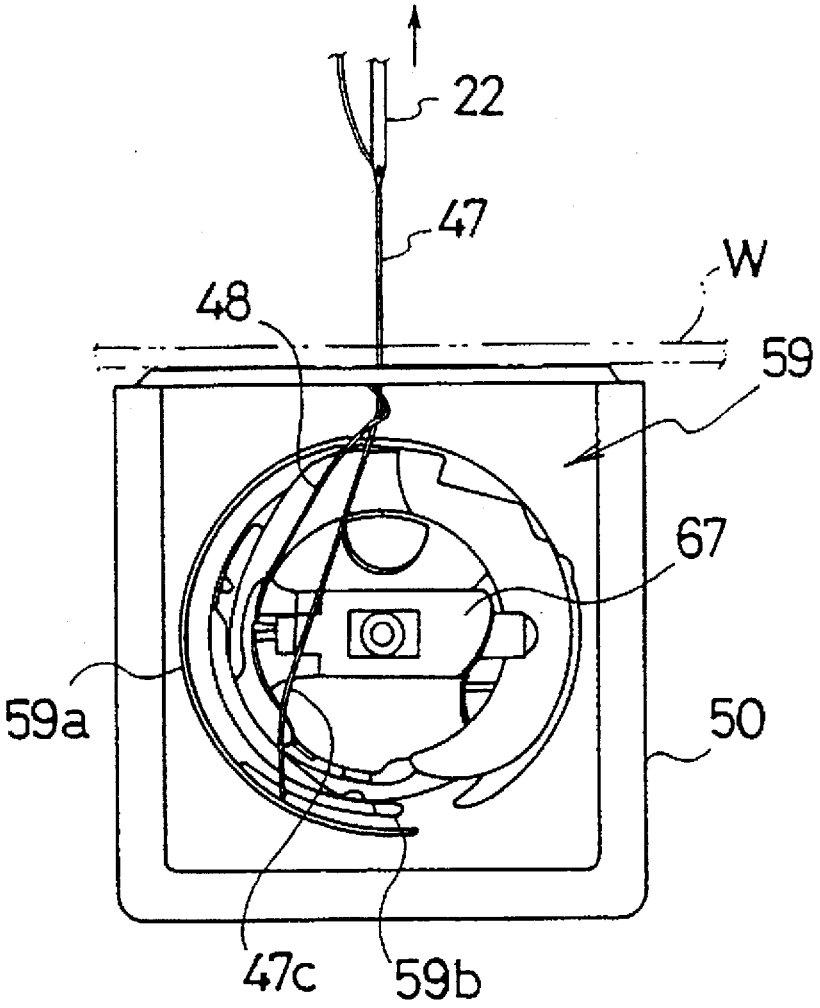
FIG. 23 is a front elevation view of the loop catcher in the form of a full-rotation shuttle when the main shaft 17 takes the rotation position of 280°.

As shown in FIG. 23, the loop catcher 59 includes a bobbin-case holder which holds a bobbin case 67, and a rotating hook 59*a* which rotates around the bobbin-case holder. The rotating hook 59*a* has a point-of-hook 59*b* which hooks a needle thread 47 to form a loop 47*c* of the needle thread 47. As shown in FIG. 21, when the main shaft 17 is at the rotation position of about 200°, the point-of-hook 59*b* meets an eye hole of the sewing needle 22, and hooks the needle thread 47 conveyed by the sewing needle 22. Subsequently, as the rotating hook 59*a* is rotated, the loop 47*c* of the needle thread 47 becomes larger and passes between the bobbin-case holder and the rotating hook 59*a*.

An encoder disk 64 which has a plurality of slits is fixed to the second connection member 63, and a second encoder sensor 65 which is provided by a photosensor (a first encoder sensor 112 will be described later) optically detects each of the slits of the encoder disk 64 and outputs a corresponding one of catcher-shaft rotation signals. The second encoder sensor 65 is fixed to the attachment block 56. When the catcher drive motor 58 is driven or operated, the rotation of the drive shaft 58*a* is transmitted to the catcher shaft 60 via the coupling device 61. Thus, the loop catcher 59 is rotated in a predetermined direction, at a rotation speed, K, which is twice higher than that of the main shaft 17. The front end portion of the bed unit 10 is covered by a protection cover 66 which is pivotally hinged to a lower end of the front end portion of the bed case 50.

Next, there will be described a supporting device which supports the loop catcher 59 such that the position of the catcher 59 is adjustable in the Y-axis direction.

The attachment block 56 includes a cylindrical portion in which a cylindrical bearing case 70 is provided such that the bearing case 70 is movable in the Y-axis direction. A bearing 71 is press-fit in the bearing case 70. An eccentric pin 72 projects from one of opposite side walls of the block 56, such that a projecting portion of the pin 72 is held in engagement with an elongate hole of a corresponding side wall of the bearing case 70. A set vis 73 is detachably attached to the other side wall of the block 56. When the set vis 73 is fastened to the block 56, the bearing case 70 is fixed in position.

When the set vis 73 is manually loosened and the eccentric pin 72 is manually rotated in a clockwise or counterclockwise direction, the bearing case 70 can be moved by a small distance (e.g., 1 to 2 mm) frontward or rearward in the Y-axis direction. Thus, the position of the loop catcher 59 in the Y-axis direction can be finely adjusted, and accordingly the clearance provided between the catcher 59 and the needle 22 can be appropriately adjusted.

Referring next to FIGS. 3 through 6, there will be described a thread cutting device 80 which is provided in each bed unit 10–12 and which cuts the needle thread 47 and a bobbin thread 48.

A stationary plate (not shown) which is fixed to an upper wall of the attachment block 56 extends above the loop catcher 59. A movable blade 81 is supported by the stationary plate such that the movable blade 81 is rotatable between a retracted position indicated in solid line in FIG. 6, and an advanced (i.e., maximum rotation) position indicated in phantom line. A stationary blade 82 cooperates with the movable blade 81 to cut the needle and bobbin threads 47, 48. The stationary blade 82 is fixed to the throat plate 52, at a position above the stationary plate, such that the stationary blade 82 is oriented frontward.

A thread-cutting operating lever 83 which is connected to the movable blade 81 extends rearward through the bed case 50. When the operating lever 83 is moved frontward, the movable blade 81 is rotated clockwise to its advanced position and, when the lever 83 is moved rearward, the blade 81 is rotated counterclockwise from the advanced position to the retracted position. During this backward rotation, a notch 81*a* of the movable blade 81 engages or catches the needle and bobbin threads 47, 48 and subsequently the movable blade 81 cooperates with the stationary blade 82 to cut the two threads 47, 48 simultaneously.

Figure 3:
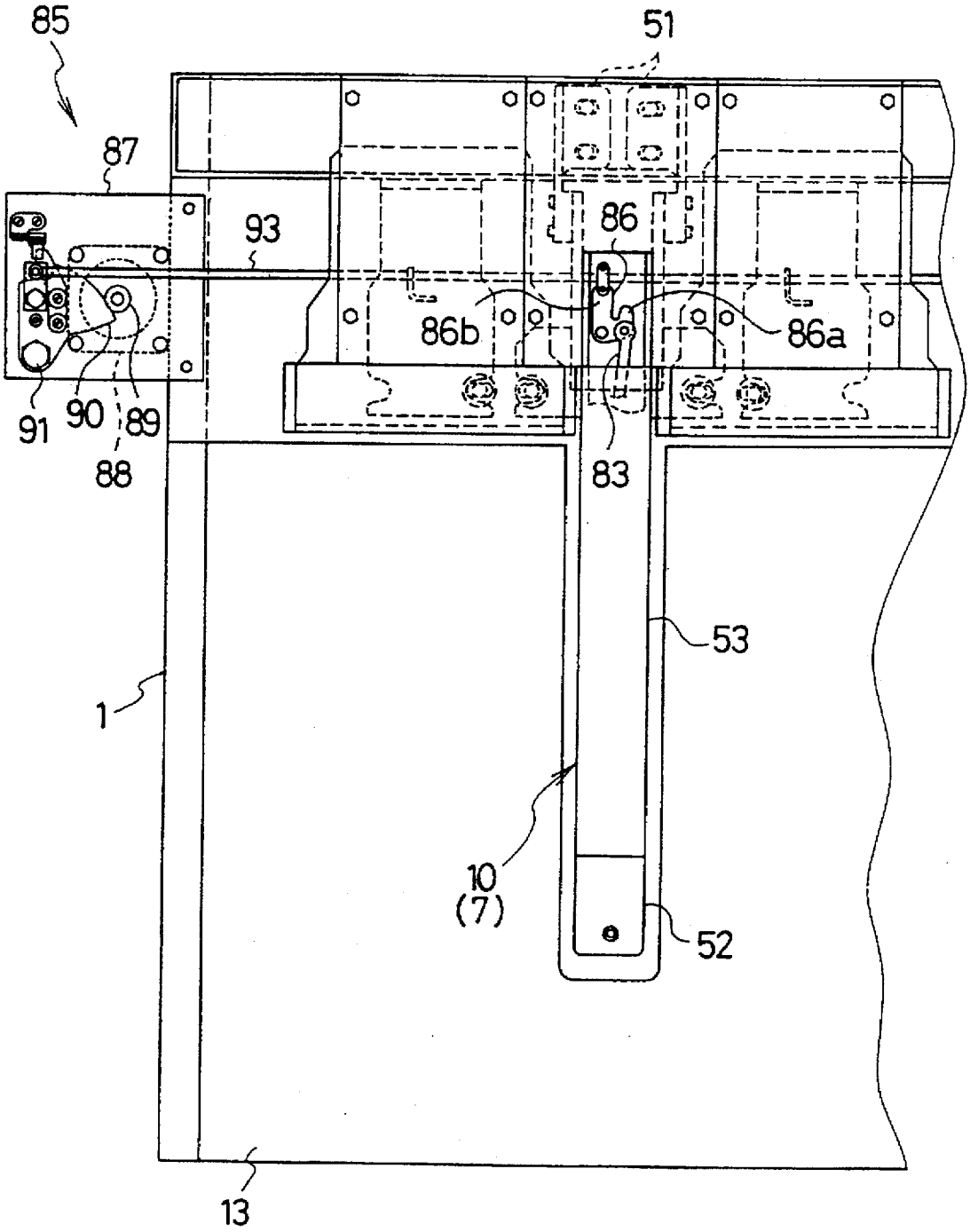
FIG. 3 is a plan view of a part of the machine of FIG. 1 which includes a part of a work table, and a bed unit.
Figure 7:
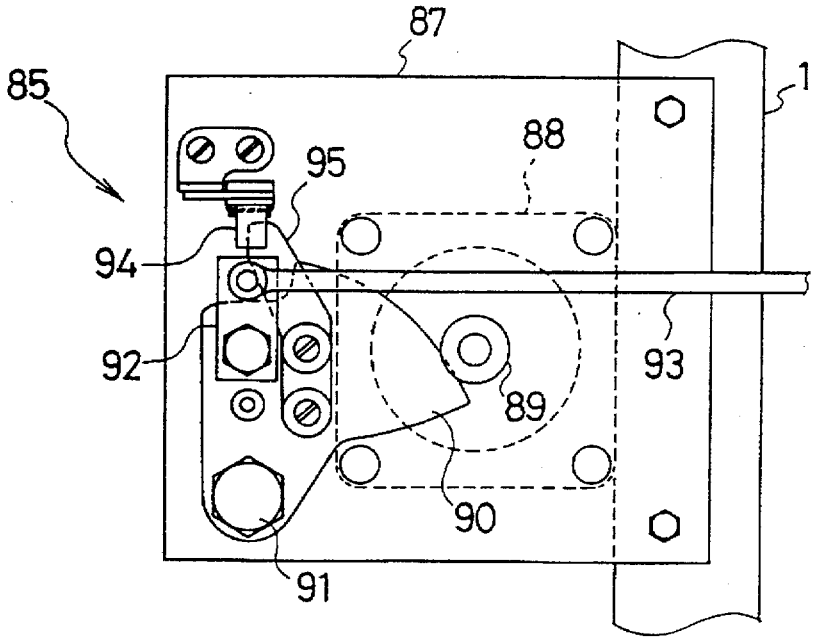
FIG. 7 is an enlarged plan view of a thread-cutting driving device.

Referring next to FIGS. 3 and 7, there will be described a thread-cutting driving device 85 which drives the thread cutting device 80.

A rear end portion of the thread-cutting operating lever 83 is connected to one 86*a* of two arms 86*a*, 86*b* of a rotary plate 86 which has a generally L shape in its plan view and which is supported by the rear end portion of the bed case 50 such that the rotary plate 86 is rotatable about a vertical axis member. An attachment plate 87 is fixed to one of opposite end portions of the base frame 1 in the X-axis direction, and a thread cutting motor 88 is attached to a lower surface of the attachment plate 87. A sector gear 90 which is meshed with a drive gear 89 of the thread cutting motor 88 is supported by the plate 87 via a stepped bolt 91 such that the sector gear 90 is rotatable about the bolt 91. A base portion of a connection plate 92 is attached to the sector gear 90, and a free end portion of the connection plate 92 is connected to one of opposite end portions of a thread-cutting operating rod 93 which extends in the X-axis direction.

The other arm 86*b* of the rotary plate 86 is connected to the thread-cutting operating rod 93. When the thread cutting motor 88 is rotated counterclockwise by a predetermined angle, the sector gear 90 and the connection plate 92 are rotated clockwise by a corresponding angle. Consequently, the thread-cutting operating rod 93 is moved rightward by a corresponding distance, and the rotary plate 86 is rotated clockwise by a corresponding angle. Thus, the thread-cutting operating lever 83 is moved frontward, and the movable blade 81 is rotated from the retracted position to the advanced position. Then, when the motor 88 is rotated clockwise by the same angle, the rod 93 is moved leftward by the same distance, and the rotary plate 86 is rotated counterclockwise by the same angle. Thus, the lever 83 is moved rearward, and the movable blade 81 is rotated from the advanced position to the retracted position. During this rotation, the blade 81 engages the needle and bobbin threads 47, 48 and cooperates with the stationary blade 82 to cut the two threads 47, 48 simultaneously.

A position sensor 94 which is provided by a photosensor is attached to the attachment plate 87, at a position near the sector gear 90. A shading plate 95 is attached to the sector gear 90. When the movable blade 81 is positioned between in its retracted position and a thread cutting position where the blade 81 cooperates with the stationary blade 82 to cut the threads 47, 48, the position sensor 94 detects the shading plate 95 and generates an "H" (high) level position signal, DS, to a catcher-shaft control device 150 (FIG. 8); and when the blade 81 is positioned between the thread cutting position and the advanced position, the sensor 94 does not detect the plate 95 and generates an "L" (low) level position signal DS to the same 150.

Referring next to FIG. 8, there will be described a main control device 100 which controls the multiple-head embroidering machine M as a whole except the bed units 10–12 and the thread-cutting driving device 85.

The main control device 100 is provided by a microcomputer including a central processing unit (CPU) 101, a read only memory (ROM) 102, and a random access memory (RAM) 103, and an input and an output interface (not shown) which are connected to the microcomputer via buses including a data bus.

Regarding the sewing head 4, the main control device 100 is connected to the needle-bar jumping solenoid 41 and the presser-foot driving solenoid 106 via respective driver circuits 105, 107, and connected to a thread breakage sensor 108. This is the case with each of the other sewing heads 5, 6. In addition, the main control device 100 is connected to the main motor 110 via a driver circuit 111, a first encoder sensor 112, a main-shaft origin sensor 113, a stop position sensor 114, the needle-bar changing motor 115 via a driver circuit 116, the X-axis driving motor 117 via a driver circuit 118, the Y-axis driving motor 119 via a driver circuit 120, and the operator's panel 18 which includes the display 18a and various switches operable for inputting various commands including a sewing start command. When an encoder disk (not shown) associated with the main motor 110 or the main shaft 17 is rotated by 360°, the first encoder sensor 112 generates a thousand slit signals to the control device 100, and the main-shaft origin sensor 113 generates a single main-shaft origin signal to the control device 100. When the needle bar 21 is positioned at a stop position corresponding to a rotation position, 100°, of the main shaft 17, the stop position sensor 114 generates a stop position signal to the control device 100.

Moreover, the main control device 100 is connected to the catcher-shaft control device 150 which controls the loop catcher 59 and the thread-cutting operation. The catcher-shaft control device 150 is provided by a microcomputer including a CPU 151, a ROM 152, and a RAM 153, and an input and an output interface (not shown) which are connected to the microcomputer via buses including a data bus.

For the bed unit 10, the catcher-shaft control device 150 is connected to the catcher driving motor 58 via a driver circuit 154, the second encoder sensor 65, and a catcher-shaft origin sensor 155. This is the case with each of the other bed units 11, 12. When the encoder disk 64 associated with the catcher driving motor 58 or the catcher shaft 60 is rotated by 360°, the second encoder sensor 65 generates five hundred slit signals to the control device 150, and the catcher-shaft origin sensor 155 generates a single catcher-shaft origin signal to the control device 150. In addition, the control device 150 is connected to the position sensor 94, and the thread cutting motor 88 via a driver circuit 156.

The main motor 110 is provided by an inductor motor and is subject to a known inverter control. The thousand slit signals, i.e., main-shaft rotation signals that are generated by the first encoder sensor 112 during each full rotation of the encoder disk associated with the main motor 110 or the main shaft 17, are divided into forty thousand pulse signals, which in turn are supplied, as main-shaft control signals, to the driver circuit 111 to drive the main motor 110.

When the driver circuit 154 is supplied with five hundred pulse signals from the catcher-shaft control device 150, the catcher driving motor 58 provided by the stepper motor is rotated by 360° and accordingly the loop catcher 59 provided by the full-rotation shuttle is rotated by 360°. Since the catcher shaft 60 is rotated at the rotation speed K twice as high as that of the main shaft 17, the catcher shaft 60 is full-rotated twice while the main shaft 17 is full-rotated once.

Figure 9:
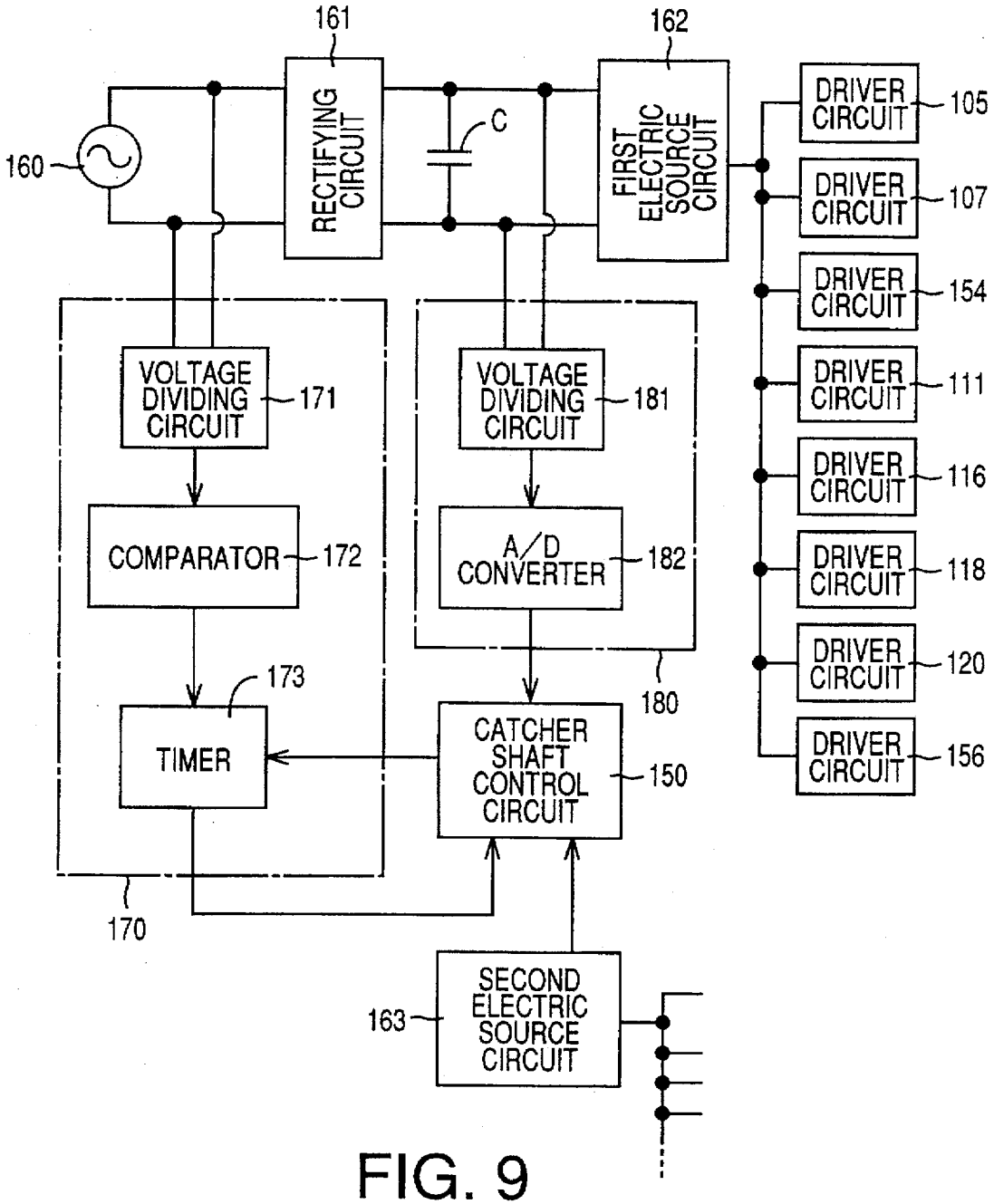
FIG. 9 is a block diagram of an electricity receiving section of the machine of FIG. 1 which receives electricity from a commercial electric source.

Referring next to FIG. 9, there will be described an electric-power or electricity supplying device which supplies an electricity to the various driver circuits 105, 107, 111, 116, 118, 120, 154, 156.

The electricity supplying device includes a first electric source circuit 162 which is connected to a commercially available electric source (i.e., alternating current tap) 160 via a rectifying circuit 161 which rectifies the alternating current into a rectified, direct drive current to be supplied to the source circuit 162.

A service-interruption detector circuit 170 which detects an interruption of the electricity supplying service is connected to a primary side of the rectifying circuit 161 on which side the tap 160 is provided, and a voltage-fall detector circuit 180 which detects an abnormal voltage fall is connected to a secondary side of the rectifying circuit 161 on which the source circuit 162 is provided. In addition, an emergency-use electric source in the form of a capacitor, C, is connected to the secondary side of the rectifying circuit 161. The capacitor C stores an electricity and supplies the stored electricity to the needle-bar jumping solenoid 41 via the driver circuit 105, upon detection of an abnormal or asynchronous state which will be described later.

Next, there will be described the service-interruption detector circuit 170 briefly. The detector circuit 170 includes a voltage dividing circuit 171 which divides the alternating voltage present on the primary side of the rectifying circuit 161, and supplies the divided voltage to a comparator 172. The comparator 172 compares the divided voltage with a reference voltage and, each time the divided voltage exceeds the reference voltage, i.e., at the same cycle as that of the alternating voltage or current, the comparator 172 supplies a reset signal to reset or clear a time measured by a timer 173. If the timer 173 counts a preset time before receiving a clear signal from the comparator 172, the timer 173 supplies a control-interruption signal to the CPU 151 of the catcher-shaft control device 150. When the electricity supplying service interrupts for some reason, the comparator 172 does not supply a clear signal before the timer 173 counts the preset time. Thus, the timer 173 detects the service interruption and supplies a control-interruption signal to the control device 150.

The voltage-fall detector circuit 180 includes a voltage dividing circuit 181 which divides the direct voltage present on the secondary side of the rectifying circuit 161, and supplies the divided voltage to an analog to digital (A/D) converter 182 which converts the divided voltage to a digital signal to be supplied to the control device 150. The main control device 100, the catcher-shaft control device 150, and other electronic components are supplied with appropriate drive voltages from a second electric source circuit 163 which is provided exclusively therefor.

Referring next to the flow charts shown in FIGS. 10 to 17, there will be described the operation of the catcher-shaft control device 150 for controlling the rotation of the loop-catcher shaft 60 connected to the loop catcher 59.

Figure 20:
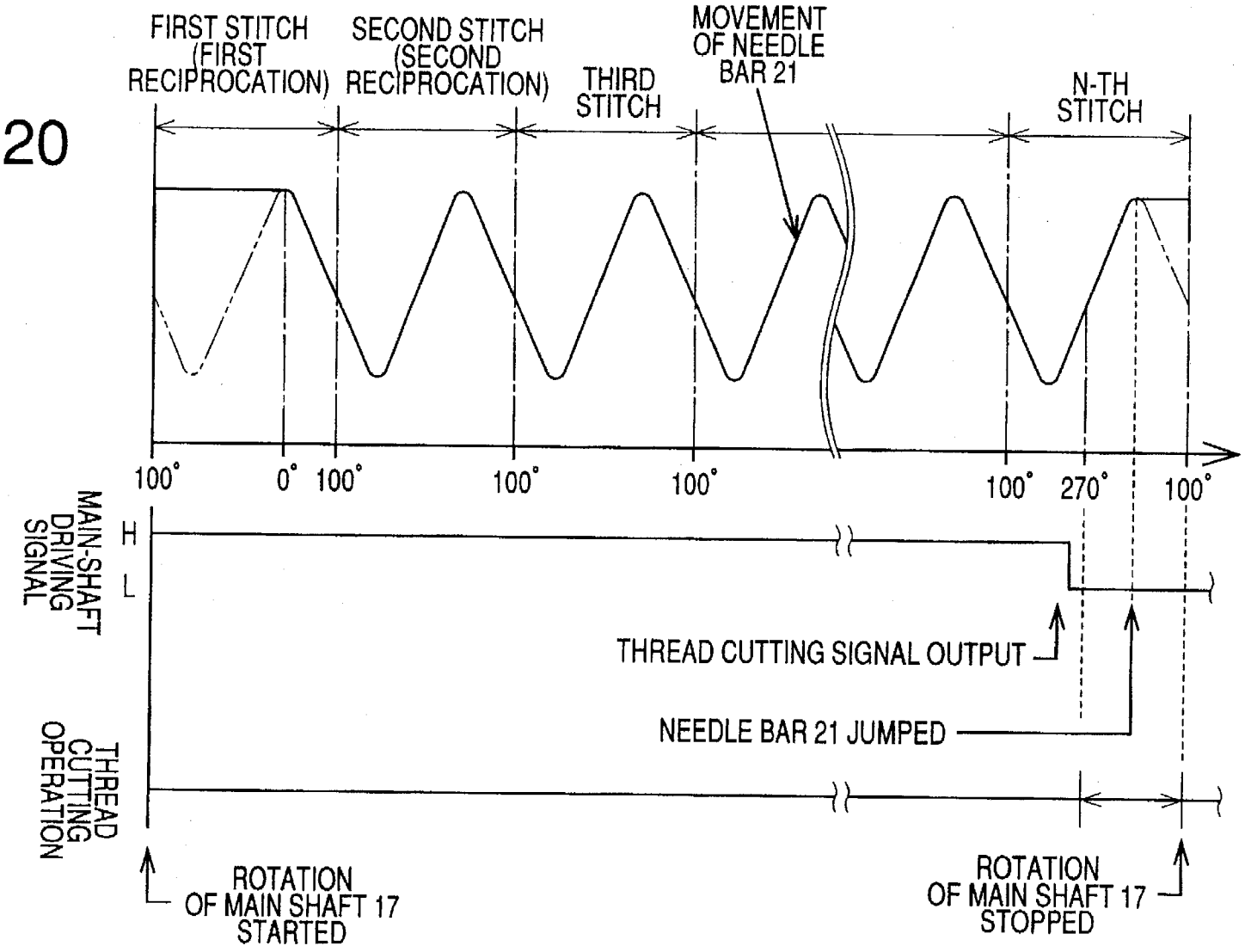
FIG. 20 is a time chart illustrating various signals which are output while an embroidery including N stitches is formed.

FIG. 20 illustrates various control signals which are supplied from the main control device 100 to the catcher-shaft control device 150. At the beginning of a sewing operation, normally, the main shaft 17 remains stopped at the stop position of 100°, and the needle bar 21 remains held at the upper-dead position as a result of being jumped up by the needle-bar jumping device 40.

It is assumed that the present machine M embroiders an embroidery according a batch of embroidery data including sets of stitch-position data corresponding to N stitches (N is a natural number). When the main control device 100 changes a main-shaft drive signal from an L (low) level to an H (high) level, the driver circuit 111 starts driving the main motor 110. It is also assumed that the embroidery data do not command any thread cutting for changing threads but command only a thread cutting at the end of formation of the N-th stitch.

FIG. 21 illustrates the movement of the needle bar 21, the movement of the take-up lever 23, the amount of the bobbin thread 48, and the rotation position of the loop catcher 59, in comparison with the rotation position of the main shaft 17, during a sewing operation. The rotation position (i.e., angular position) of the loop catcher 59 indicates the rotation position of the point-of-hook 59*a*.

As shown in FIG. 20, when the sewing needle 22 is first reciprocated, the needle bar 21 is automatically connected to the drive member 27 when the main shaft takes 0°, i.e., when the needle bar 21 takes the upper-dead position. Thus, in fact, the first stitch is not formed although the needle 22 is reciprocated. Meanwhile, when the N-th stitch is formed and the main shaft 17 takes 260°, the main-shaft drive signal is changed from the H level to the L level, and a thread cutting signal is supplied from the main control device 100 to the catcher-shaft control device 150. While the main shaft 17 is rotated from 270° to 440° (80°), a thread cutting operation is effected. During this period, when the main shaft 17 takes 360°, i.e., when the needle bar 21 takes the upper-dead position, the needle bar 21 is disconnected from the drive member 27, but does not jump up. Subsequently, when the main shaft 17 takes 460° (100°), the rotation of the main shaft 17 is stopped at the stop position.

Figure 10:
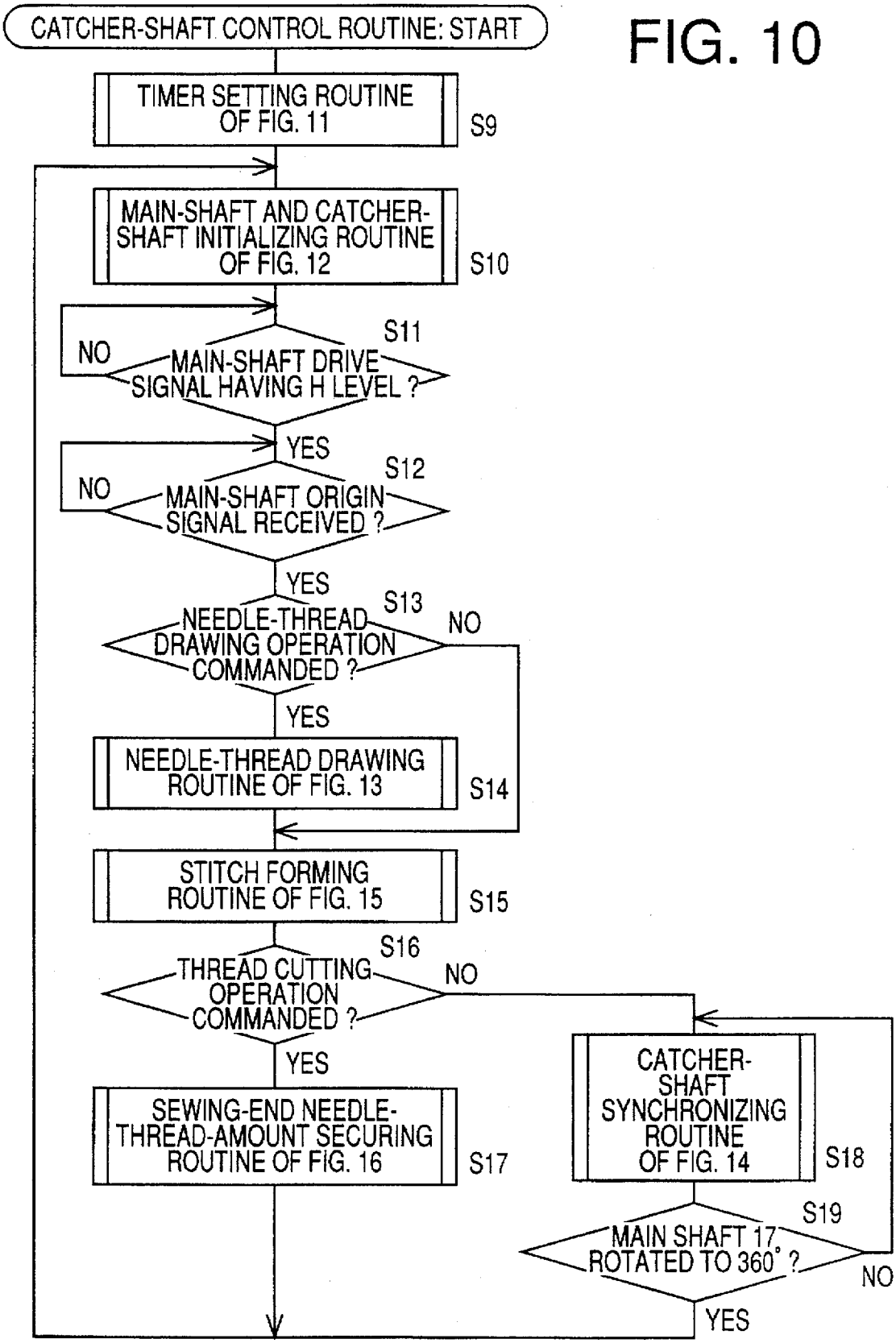
FIG. 10 is a flow chart representing a catcher-shaft control routine according to which a catcher-shaft control device of the machine of FIG. 1 controls the rotation of a loop-catcher shaft.

Upon application of an electric power to the present multiple-head embroidering machine M, the catcher-shaft control device 150 begins with Step S9 of the catcher-shaft control routine shown in FIG. 10. Step S9 corresponds to the timer setting routine, shown in FIG. 11, in which a reference time is set in the timer 173 of the service-interruption detector circuit 170. More specifically described, at Step S20, the control device 150 supplies, to the timer 173, a reference time which is equal to two and half times as long as the period, ACt, of the alternating current being supplied to the machine M. For example, in the case where the frequency of the alternating current is 60 Hz, the control device 150 presets a reference time equal to 16 (msec) ×2.5, in the timer 173. Step S20 is followed by Step S21 to reset or clear the time measured, i.e., value counted, by the timer 173 so that the timer 173 re-starts to measure time. Step S21 is followed by Step S22 at which if the time measured by the timer 173 exceeds the reference time, the timer 173 supplies a control-interruption signal to the control device 150. On the other hand, if the comparator 172 supplies a rest or clear signal to the timer 173 before the timer 173 counts up the reference time, the timer 173 re-starts measuring time.

Figure 12:
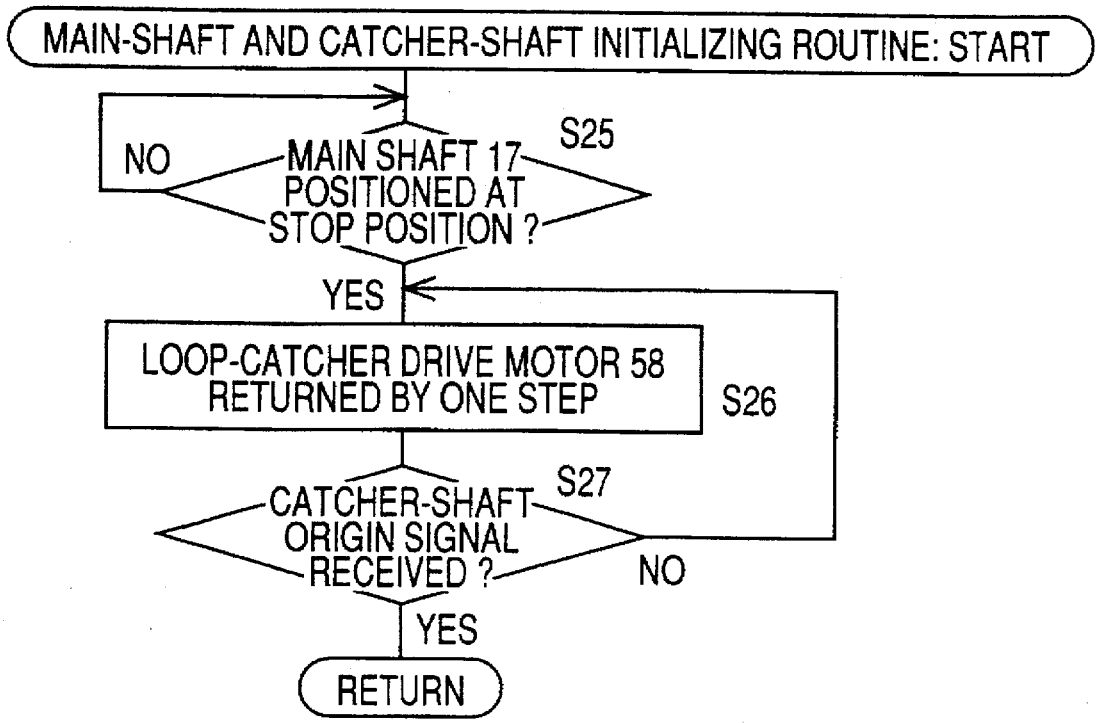
FIG. 12 is a flow chart representing a main-shaft and catcher-shaft initializing routine.

Then, the control of the CPU 151 of the control device 150 proceeds with Step S10, i.e., main-shaft and catcher-shaft initializing routine shown in FIG. 12.

Figure 24:
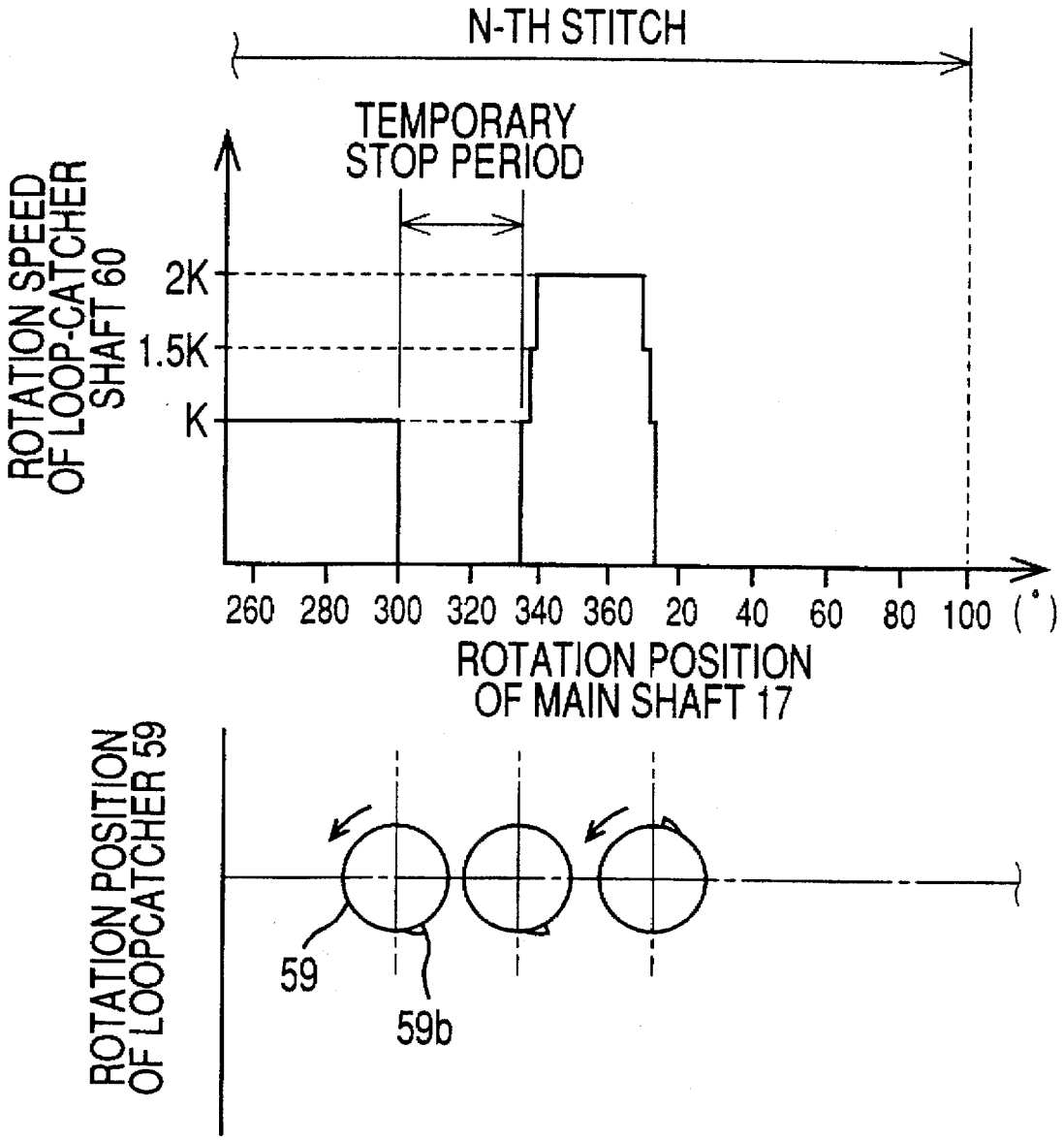
FIG. 24 is a time chart illustrating the rotation speed of the loop-catcher shaft in comparison with the rotation position of the main shaft when a thread cutting operation is effected.

At Step S25, the CPU 151 judges whether the main shaft 17 is positioned at the stop position, i.e., at 100°, based on the detection signal supplied from the stop-position sensor 114. When a prior sewing operation is ended after a thread cutting operation, the main shaft 17 is stopped at the stop position. Therefore, usually, a positive judgment is made at Step S25. Accordingly, the control goes to Step S26. As shown in FIG. 24, at the beginning of a sewing operation, the loop catcher 59 (i.e., point-of-hook 59*a*) is positioned at a phase corresponding to 13° of the main shaft 17. Therefore, at Step S26, the control device 150 supplies one pulse signal to the driver circuit 154 to rotate the catcher drive motor 58 (i.e., stepper motor) by one step, i.e., a predetermined angle, in order to return the catcher shaft 60 to the catcher-shaft origin where the catcher-shaft origin sensor 155 supplies a catcher-shaft origin signal to the control device 150. Step S26 is followed by Step S27 to judge whether the control device 150 has received the catcher-shaft origin signal from the sensor 155. If a negative judgment is made at Step S27, Steps S26 and S27 are repeated. When the loop-catcher shaft 60 is returned to the origin position, as shown in FIG. 22, which corresponds to the stop position (100°) of the main shaft 17, a positive judgment is made at Step S27, and the control of the CPU 151 goes to Step S11.

On the other hand, if a negative judgment is made at Step S25, the main control device 100 is operated to control the display 18*a* to indicate an error message informing an operator of that situation. Then, the operator can manually rotate the main shaft 17 to the stop position.

If the main control device 100 does not output a main-shaft drive signal having an H level, no sewing operation is started. In this case, a negative judgment is made at Step S11. Step S11 is repeated until a positive judgment is made. As shown in FIG. 20, when the main control device 100 supplies a main-shaft drive signal having an H level and a sewing operation is started, a positive judgment is made at Step S11. Thus, the rotation of the main motor 110 is started and the main shaft 17 is rotated from the stop position, i.e., 100°. At this time, however, the rotation of the loop catcher 59 is not started.

Figure 22:
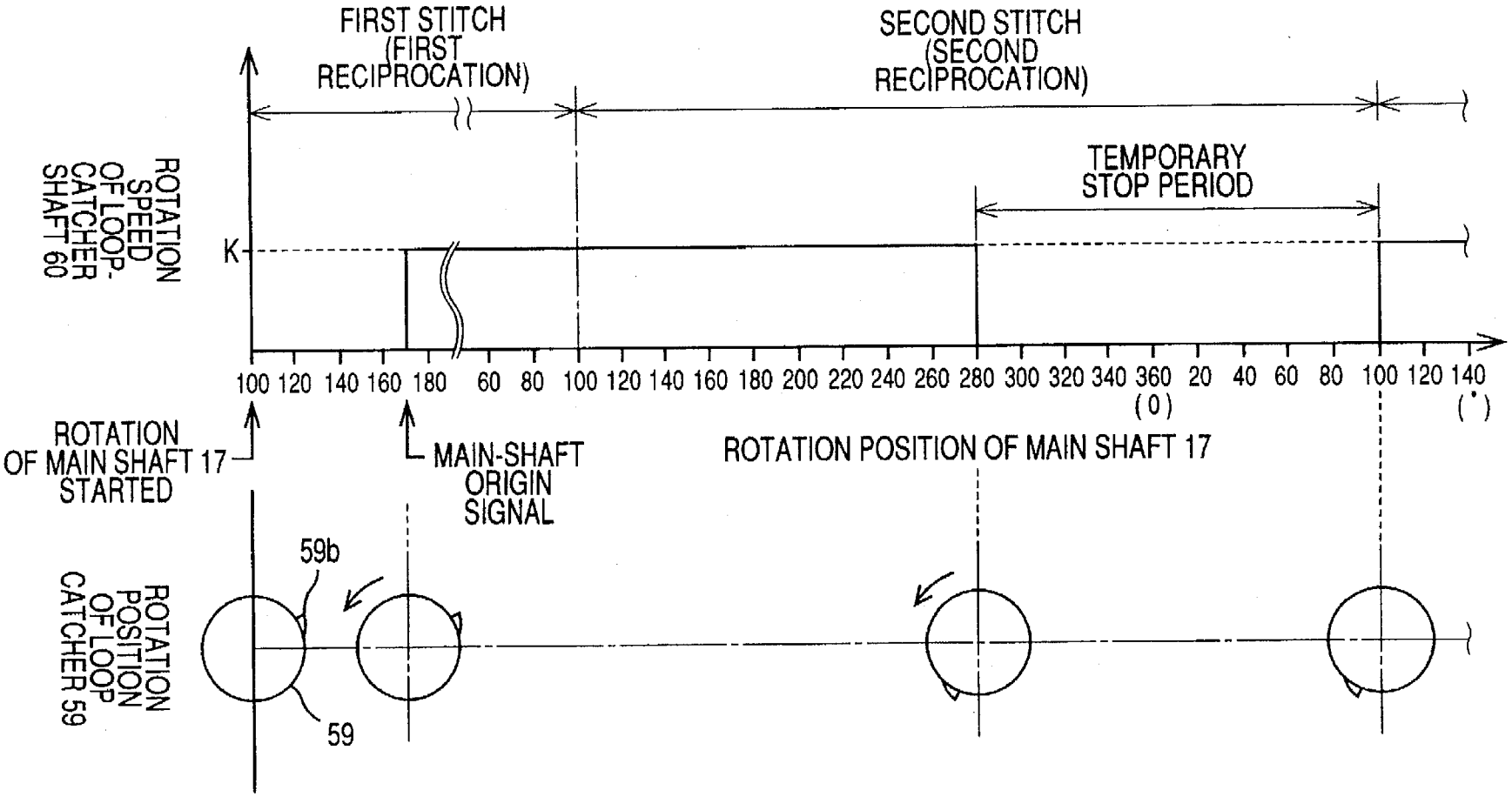
FIG. 22 is a time chart illustrating the rotation speed of the loop-catcher shaft in comparison with the rotation position of the main shaft when a sewing operation is started.

As shown in FIG. 22, when the main shaft 17 is rotated to 170° during the first reciprocation of the sewing needle 22 following the commencement of the sewing operation, the main-shaft origin sensor 113 generates a main-shaft origin signal to the main control device 100. Thus, a positive judgment is made at Step S12. Step S12 is followed by Step S13 to judge whether the main control device 100 is commanding the catcher-shaft control device 150 to carry out a needle-thread drawing operation at Step S14, i.e., the needle-thread drawing routine shown in FIG. 13. If a positive judgment is made at Step S13, the control of the CPU 151 goes to Step S14. The needle-thread drawing operation is carried out to draw the needle thread 48 conveyed by the sewing needle 22, to the underside of a work sheet W such as a fabric or a leather.

At Step S30, the catcher-shaft control device 150 carries out the catcher-shaft synchronizing routine shown in FIG. 14.

At Step S40, the control device 150 reads a current rotation or angular position, i.e, current phase of the main shaft 17, by counting the number of main-shaft rotation signals supplied from the first encoder sensor 112 to the main control device 100 after the main-shaft origin signal is issued. While the main shaft 17 is rotated by 360°, a thousand main-shaft rotation signals are supplied from the sensor 112 to the control device 100, and four thousand pulse signals are supplied to the driver circuit 111 to rotate the main motor 110, as described previously. Step S40 is followed by Step S41 to judge whether it is a timing to rotate the catcher-shaft drive motor 58 by one step so as to synchronize the loop-catcher shaft 60 with the rotation of the main shaft 17. A positive judgment is made at Step S41, each time the main control device 100 supplies every fourth pulse signal to the main motor 110. If a positive judgment is made at Step S41, the control of the CPU 151 goes to Step S42 to supply one pulse signal to the driver circuit 154 to rotate the catcher-shaft drive motor (stepper motor) 58 by one step.

Step S42 is followed by Step S43 to add one to a value, I, counted by a counter provided in the RAM 153 of the control device 150. The counter counts the number of pulse signals supplied from the control device 150 to the driver circuit 154 to drive the loop-catcher drive motor 58. Subsequently, at Step S44, the CPU 151 judges whether the control device 150 has received a catcher-shaft rotation signal from the second encoder sensor 65, in order to judge whether the loop-catcher shaft 60 is rotating. If a negative judgment is made at Step S44, the control of the CPU 151 goes to Step S45 to judge whether the counted value I is not greater than a reference value, P (e.g., ten to fifteen). If a positive judgment is made at Step S45, the control of the CPU 151 quits this routine and goes to Step S31 of the routine of FIG. 13. On the other hand, if a positive judgment is made at Step S44, the control goes to Step S46 to clear the value I counted by the counter, to zero, and then goes to Step S31.

On the other hand, if a negative judgment is made at Step S41, the control goes to Step S47 to judge whether the control device 150 has received a catcher-shaft origin signal from the catcher-shaft origin sensor 155. If a negative judgment is made at Step S47, the control goes to Step S48 to read a detected voltage, $V_K$, supplied from the A/D converter 182 of the voltage-fall detector circuit 180. Step S48 is followed by Step S49 to judge whether the detected voltage $V_K$ is not higher than a reference voltage, $V_S$, at which the main motor 110 and/or the loop-catcher drive motor 58 cannot normally operate. If a negative judgment is made at Step S49, the control goes to Step S31. On the other hand, if a positive judgment is made at Step S47, the control goes to Step S50 to calculate, based on the current phase of the main shaft 17 read at Step S40, an actual pulse-signal number representing the number of pulse signals which are actually supplied to the drive motor 58 during a time period in which the loop-catcher shaft 60 is rotated by 360° from the time of prior detection of the origin position thereof corresponding to 170° of the main shaft 17, to the time of current detection of the origin position thereof detected at Step S47. In the ROM 152, a nominal pulse-signal number representing the number of pulse signals which are nominally supplied to the drive motor 58 during the same time period, is pre-stored. In addition, the ROM 152 stores a reference pulse-signal number representing a permissible difference between the actual pulse-signal number and the nominal pulse-signal number for synchronizing the rotation of the loop catcher 58 with the rotation of the main shaft 17, i.e. the reciprocation of the needle bar 21. The ROM 152 may additionally store a table representing a relationship between actual phases of the main shaft 17 and corresponding actual pulse-signal numbers. At Step S50, the CPU 151 judges whether the difference between the actual and nominal pulse-signal number is smaller than the reference pulse-signal number. If a positive judgment is made at Step S50, the control of the CPU 151 goes to Step S31.

Figure 17:
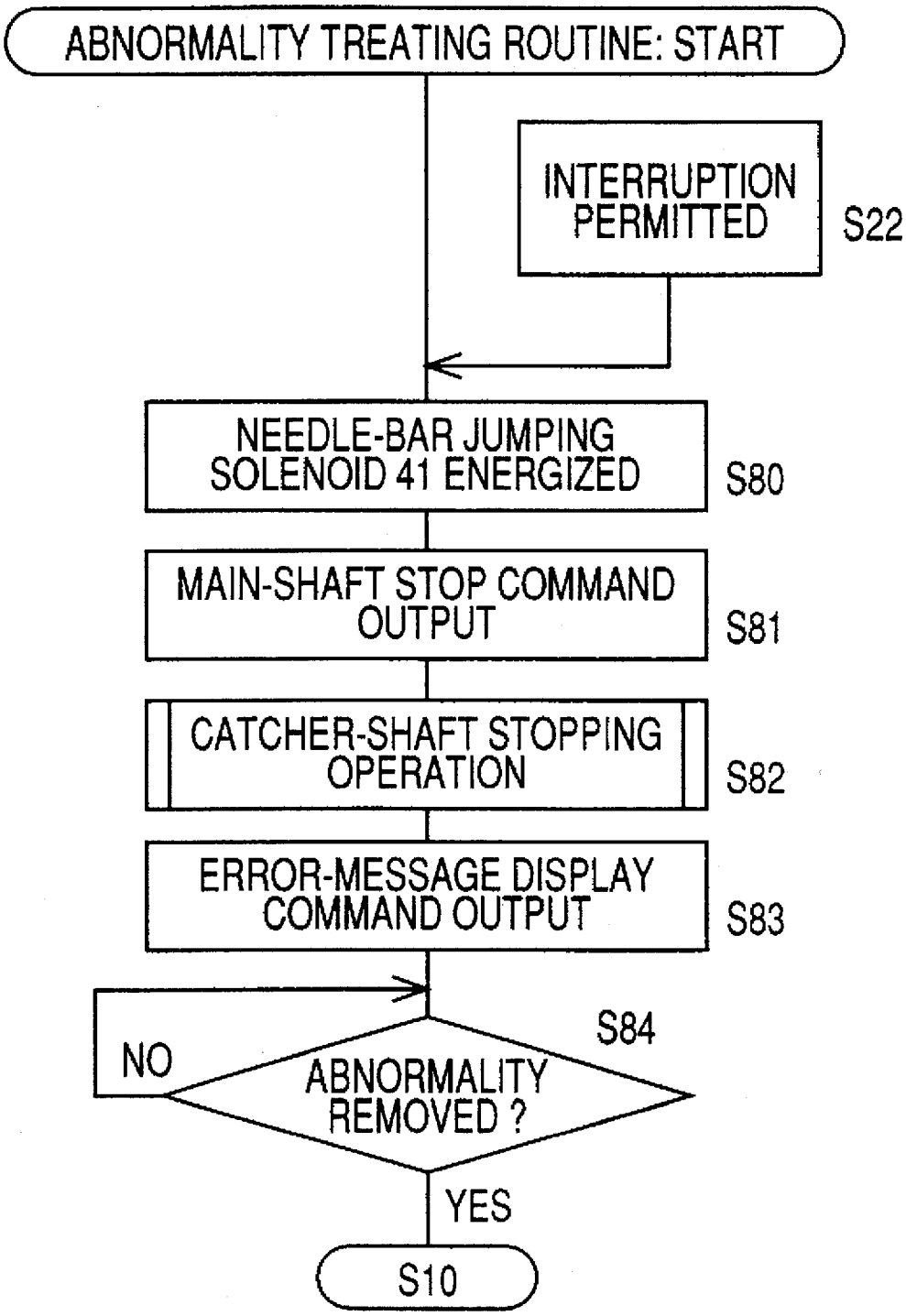
FIG. 17 is a flow chart representing an abnormality treating routine.

On the other hand, if a positive judgment is made at Step S49 or if a negative judgment is made at Step S45 or Step S50, the control of the CPU 151 goes to Step S51, i.e., abnormality treating routine shown in FIG. 17. In the case where a positive judgment is made at Step S49 or a negative judgment is made at Step S45, the control device 150 identifies that the loop-catcher shaft 60 is rotating in an asynchronous state in which it is expected that the amount of asynchronism between the needle bar 21 and the loop catcher 59 will exceed a permissible amount which may, or may not, correspond to the reference pulse-signal number pre-stored in the ROM 152. Meanwhile, in the case where a negative judgment is made at Step S50, the control device 150 identifies that the loop-catcher shaft 60 is rotating in an asynchronous state in which the amount of asynchronism between the needle bar 21 and the loop catcher 59 is now greater than a permissible amount which corresponds to the reference pulse-signal number pre-stored in the ROM 152.

At Step S80, the main control device 100 controls the driver circuit 105 to drive or energize the needle-bar jumping solenoid 41 for a predetermined time duration. To this end, the catcher-shaft control device 150 operates for causing the capacitor C to supply the stored electricity to the solenoid 41 via the circuit 105. Thus, the solenoid 41 quickly and reliably responds to the abnormality. Consequently the drive member 27 is rotated to the non-engageable position and accordingly the needle bar 21 jumps up to the upper-dead position thereof, as described previously. Thus, the sewing needle 22 is effectively prevented from colliding with the loop catcher 59 because of the excessive asynchronism between the needle bar 21 and the loop catcher 59 and/or the excessive fall of the electric voltage supplied to the present machine M.

Step S80 is followed by Step S81 to output, to the main control device 100, a main-shaft drive stop command to stop the main motor 110. Thus, the main control device 100 supplies a brake operating signal to the driver circuit 111 to apply brake to the main motor 110 and instantly stop the same 110. Step S81 is followed by Step S82, i.e., loop-catcher drive motor stopping routine in which the control device 150 supplies a brake operating signal to apply brake to the drive motor 58 to stop the rotation of the drive motor 58 simultaneously with the stopping of the main motor 110. Subsequently, at Step S83, the control device 150 supplies, to the main control device 100, a command to control the display 18*a* to indicate an error message informing the operator of the situation that the two motors 110, 58 have been stopped because of the detection of abnormality. If the operator removes the abnormality and operates an error resetting switch (not shown) provided on the operator's panel 18, a positive judgment is made at Step S84. Then, the control of the CPU 151 goes back to Step S10 of FIG. 10.

Meanwhile, when the electricity supplying service interrupts for some reason, the service-interruption detector circuit 170 detects the service interruption since the comparator 172 does not supply a clear signal to the timer 173 before the timer 173 counts up the reference time. Thus, the timer 173 supplies a control-interruption signal to the control device 150 at Step S22 of FIG. 11. Accordingly, the control device 150 carries out the abnormality treating routine of FIG. 17. Thus, the needle bar 21 jumps up to the upper dead position, and the sewing needle 22 is effectively prevented from colliding with the loop catcher 59 because of the interruption of the electricity or electric-power supplying service.

Figure 13:
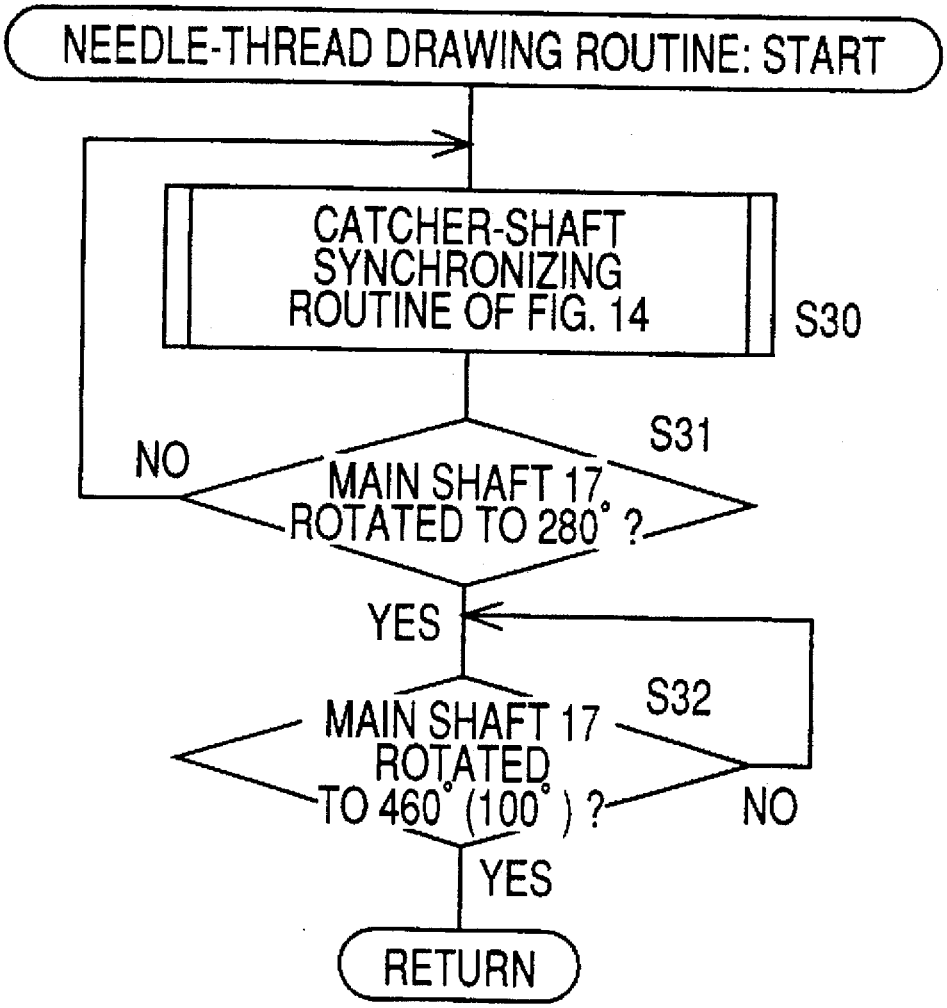
FIG. 13 is a flow chart representing a needle-thread drawing routine.

In the needle-thread drawing routine of FIG. 13, Step S30 is followed by Step S31 to judge whether the main shaft 17 has been rotated to 280°. If a negative judgment is made at Step S31, Steps S30 and S31 are repeated. As shown in FIG. 22, when the main shaft 17 has been rotated to 280° during the second reciprocation of the sewing needle 22, that is, if a positive judgment is made at Step S31, the control of the CPU 151 goes to Step S32 to stop the operation of the catcher-shaft drive motor 58, thereby stopping the rotation of the loop-catcher shaft 60, and judge whether the main shaft 17 has been rotated to 460° (100°).

While the main shaft 17 is rotated from 280° to 460° during the second reciprocation of the sewing needle 22, the loop catcher 59 is taking a rotation position, shown in FIG. 23, at which the loop 47*c* of the needle thread 47 made by the point-of-hook 59*b* has not been released from the loop catcher 59 yet, the work sheet W is being fed, and the needle 22 and the take-up lever 23 are being moved upward.

As the sewing needle 22 and the take-up lever 23 are moved upward, the needle thread 47 is drawn up through the eye hole of the needle 22. Thus, the free end portion of the needle thread 47 passes through the work sheet W and the needle throat 52*a* of the throat plate 52, from the upperside of the sheet W to the underside of the same W, i.e., to the side of the loop catcher 59. Thus, the loop 47*c* is eliminated.

Figure 15:
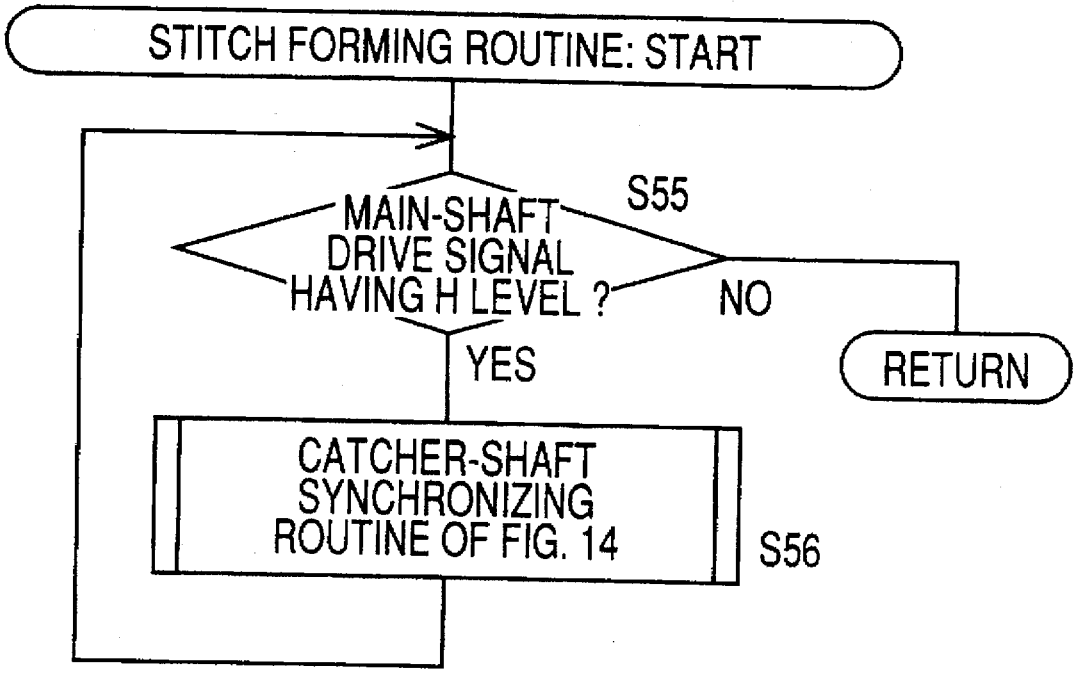
FIG. 15 is a flow chart representing a stitch forming routine.

Then, if a positive judgment is made at Step S32, that is, if the main shaft 17 has been rotated to 460° (100°) at which the rotation of the loop catcher 59 is resumed, the control of the CPU 151 goes to Step S15 of FIG. 10, i.e., the stitch forming routine, shown in FIG. 15, in which stitches are actually formed on the work sheet W.

At Step S55, the CPU 151 judges whether the main-shaft drive signal supplied from the main control device 100 to the main motor 110 has the H level. If the current sewing operation has entered the third reciprocation of the sewing needle 22, a positive judgment is made at Step S55, and the control goes to Step S56 to carry out the above-described catcher-shaft synchronizing routine of FIG. 14. Steps S55 and 56 are repeated till the formation of the N-th stitch, i.e., the last stitch. After the last stitch is formed, the main-shaft drive signal is changed from the H level to the L level as shown in FIG. 20. Thus, a negative judgment is made at Step S55, and the control of the CPU 151 quits this routine and goes to Step S16 of FIG. 10. Thus, stitches are sequentially formed, one by one, on the work sheet W.

At Step S16, the CPU 151 judges whether the main control device 100 commands the catcher-shaft control device 150 to carry out a thread cutting operation after the formation of the last stitch. If a negative judgment is made at Step S16, the control goes to Step S18 to perform the catcher-shaft synchronizing routine of FIG. 14 and then to Step S19 to judge whether the main shaft 17 has been rotated to 360°. If a negative judgment is made at Step S19, Steps S18 and S19 are repeated so that the point-of-hook 59*b* may not collide with the sewing needle 22. Meanwhile, if a positive judgment is made at Step S19, the control of the CPU 151 goes back to Step S10.

Figure 16:
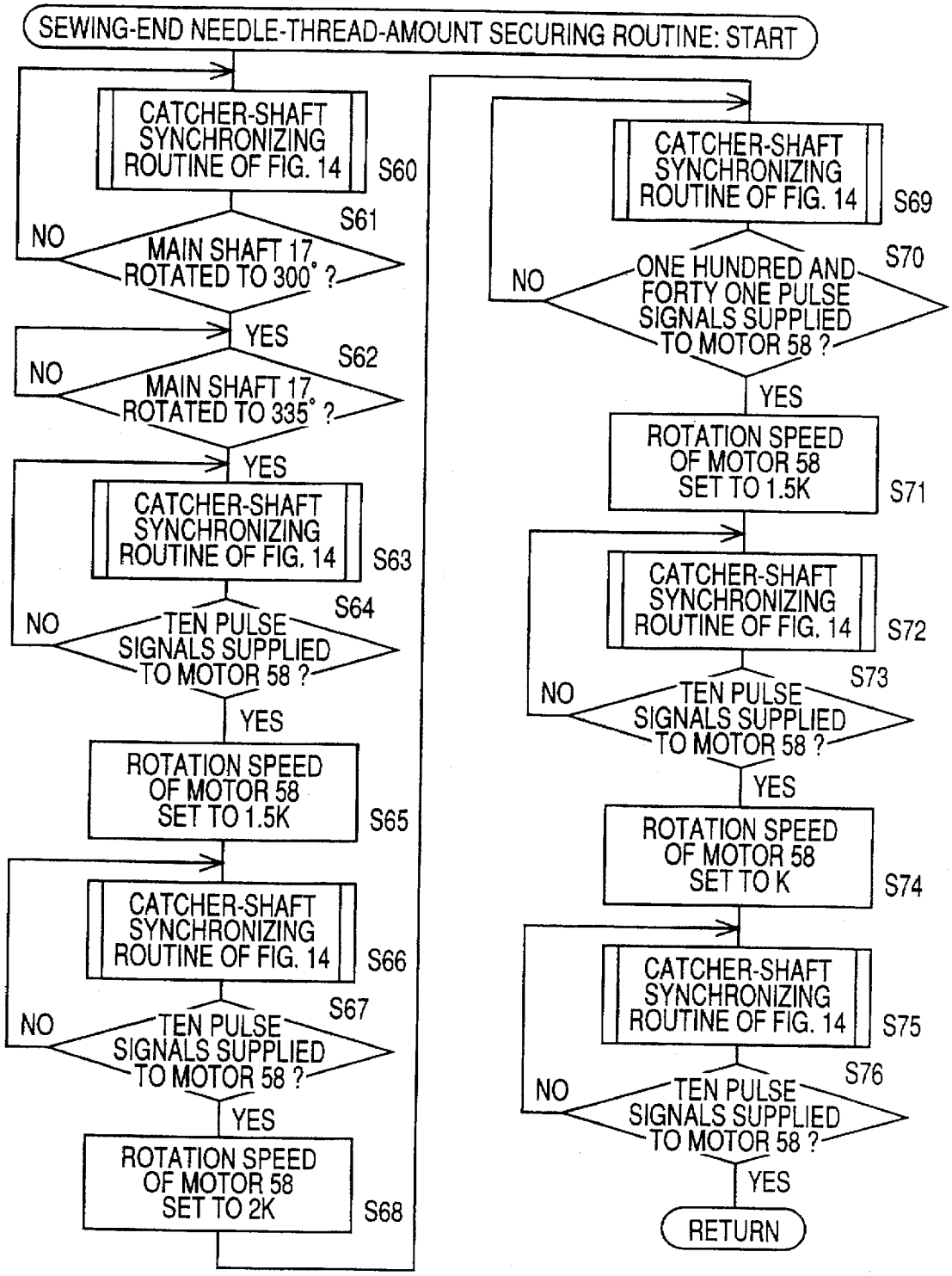
FIG. 16 is a flow chart representing a sewing-end needle-thread-amount securing routine.

On the other hand, if a positive judgment is made at Step S16, the control of the CPU 151 goes to Step S17, i.e. the sewing-end needle-thread-amount securing routine shown in FIG. 16. Substantially simultaneously with the commencement of the sewing-end needle-thread-amount securing routine, the control device 150 starts carrying out the thread cutting routine shown in FIG. 19, when the main shaft 17 is rotated to 270°. The thread cutting routine will be described later.

In the needle-thread-amount securing routine, a sufficient amount or length of the needle thread 47 between the free end thereof and the eye hole of the sewing needle 22 is secured. At Step S60, the CPU 151 carries out, during the formation of the last stitch, the catcher-shaft synchronizing routine of FIG. 14 while rotating the loop-catcher drive motor 60 at the predetermined rotation speed K, as shown in FIG. 24. Step S60 is followed by Step S61 to judge whether the main shaft 17 has been rotated to 300°. If a negative judgment is made at Step S61, Steps S60 and S61 are repeated.

When a positive judgment is made at Step S61, the control of the CPU 151 goes to Step S62 to temporarily stop the operation of the loop-catcher drive motor 60, thereby forcibly stopping the rotation of the loop catcher 59, and judge whether the main shaft 17 has been rotated to 335°. If a negative judgment is made at Step S62, Step S62 is repeated.

Figure 25:
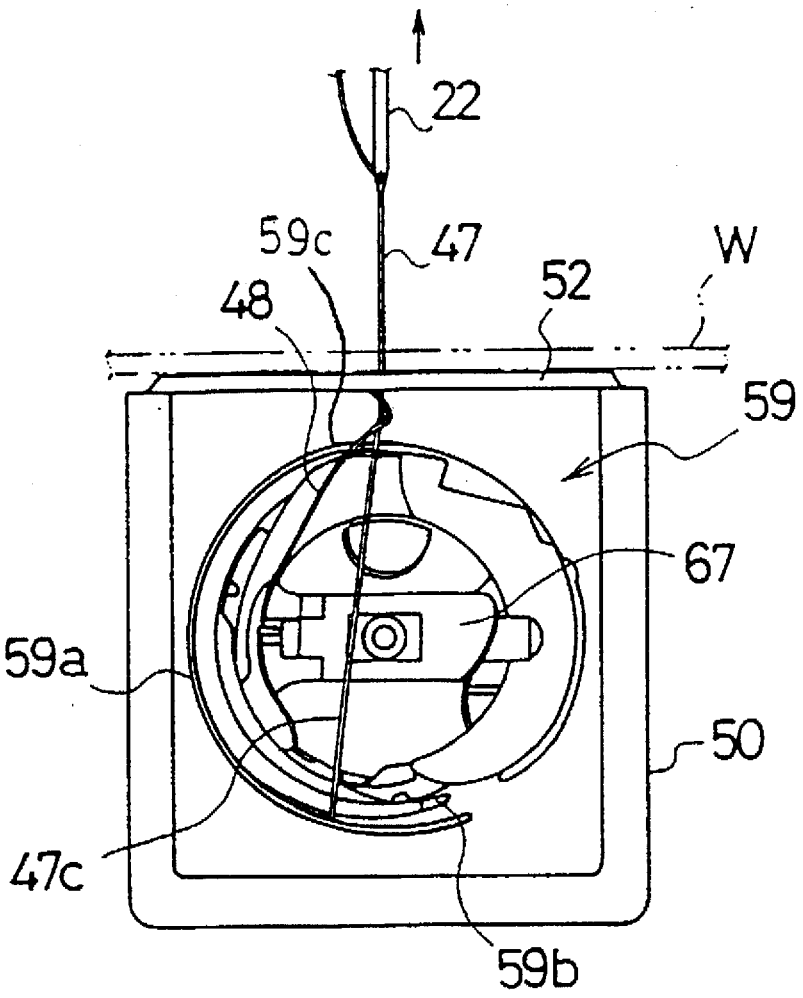
FIG. 25 is a front elevation view of the full-rotation shuttle when the shuttle is temporarily stopped with the main shaft 17 taking the rotation position of 300°.

While the main shaft 17 is rotated from 300° to 335° during the formation of the N-th stitch, the loop catcher 59 is taking a rotation position, as shown in FIG. 25, at which the loop 47*c* of the needle thread 47 has not been released from the loop catcher 59, the work sheet W is being fed, and the needle 22 and the take-up lever 23 are being moved upward. Since, in this situation, the rotation of the loop catcher 59 is temporarily stopped, the length of the needle thread 47 between the work sheet W and the eye hole of the sewing needle 22 increases as the take-up lever 23 is moved up. Accordingly, the needle thread 47 is fed from a needle-thread supplying spool (not shown).

Thus, a sufficient length of the needle thread 47 will be secured after the thread 47 is cut between the work sheet W and the sewing needle 22 in a thread cutting operation described later. Therefore, the cut end portion of the needle thread 47 is effectively prevented from coming off the eye hole of the needle 22 when the next sewing operation is started.

Meanwhile, if a positive judgment is made at Step S62, the control of the CPU 151 goes to Steps S63 to S76 at which the CPU 151 controls, while the main shaft 17 is rotated over about 38°, the loop-catcher drive motor 58 such that the motor 58 is rotated at a high speed proportional to the rotation speed of the main shaft 17 and such that the frequency of supplying of drive pulse signals does not exceed a self-start frequency of the motor 58. Thus, the needle-thread loop 47*c* is quickly released from the loop catcher 59, and an accurate amount of the thread 47 is secured.

More specifically described, at Step S63, the CPU 151 carries out the catcher-shaft synchronizing routine of FIG. 14. Step S63 is followed by Step S64 to judge whether the first ten drive pulse signals have been supplied, after the main shaft 17 reaches the phase of 335°, to the drive motor 58 to rotate the loop-catcher shaft 60 at the speed K. If a negative judgment is made at Step S64, Steps S63 and S64 are repeated. If a positive judgment is made at Step S64, the control goes to Step S65 to change the frequency of supplying of drive pulse signals to a higher one at which the loop-catcher shaft 60 is rotated at a speed, 1.5K, which is one and half times higher than the rotation speed K. Subsequently, at Step S66, the CPU 151 carries out the catcher-shaft synchronizing routine of FIG. 14, and then, at Step S67, the CPU 151 judges whether the next ten drive pulse signals have been supplied to the drive motor 58 to rotate the loop-catcher shaft 60 at the speed 1.5K. If a positive judgment is made at Step S67, the control goes to Step S68 to change the frequency of supplying of drive pulse signals to a still higher one at which the loop-catcher shaft 60 is rotated at a speed, 2K, which is twice higher than the rotation speed K. Subsequently, at Step S69, the CPU 151 carries out the catcher-shaft synchronizing routine of FIG. 14, and then, at Step S70, the CPU 151 judges whether one hundred and forty one pulse signals have been supplied to the drive motor 58 to rotate the loop-catcher shaft 60 at the speed 2K. If a positive judgment is made at Step S70, the control goes to Step S71 to change the signal-supplying frequency to a lower one at which the loop-catcher shaft 60 is rotated at the speed 1.5K. Subsequently, at Step S72, the CPU 151 carries out the catcher-shaft synchronizing routine of FIG. 14, and then, at Step S73, the CPU 151 judges whether ten drive pulse signals have been supplied to the drive motor 58 to rotate the loop-catcher shaft 60 at the speed 1.5K. If a positive judgment is made at Step S73, the control goes to Step S74 to change the signal-supplying frequency to a still lower one at which the loop-catcher shaft 60 is rotated at the speed K. Subsequently, at Step S75, the CPU 151 carries out the catcher-shaft synchronizing routine of FIG. 14, and then, at Step S76, the CPU 151 judges whether the next ten drive pulse signals have been supplied to the drive motor 58 to rotate the loop-catcher shaft 60 at the speed K. If a positive judgment is made at Step S73, the control goes back to Step S10 of FIG. 10.

Figure 19:
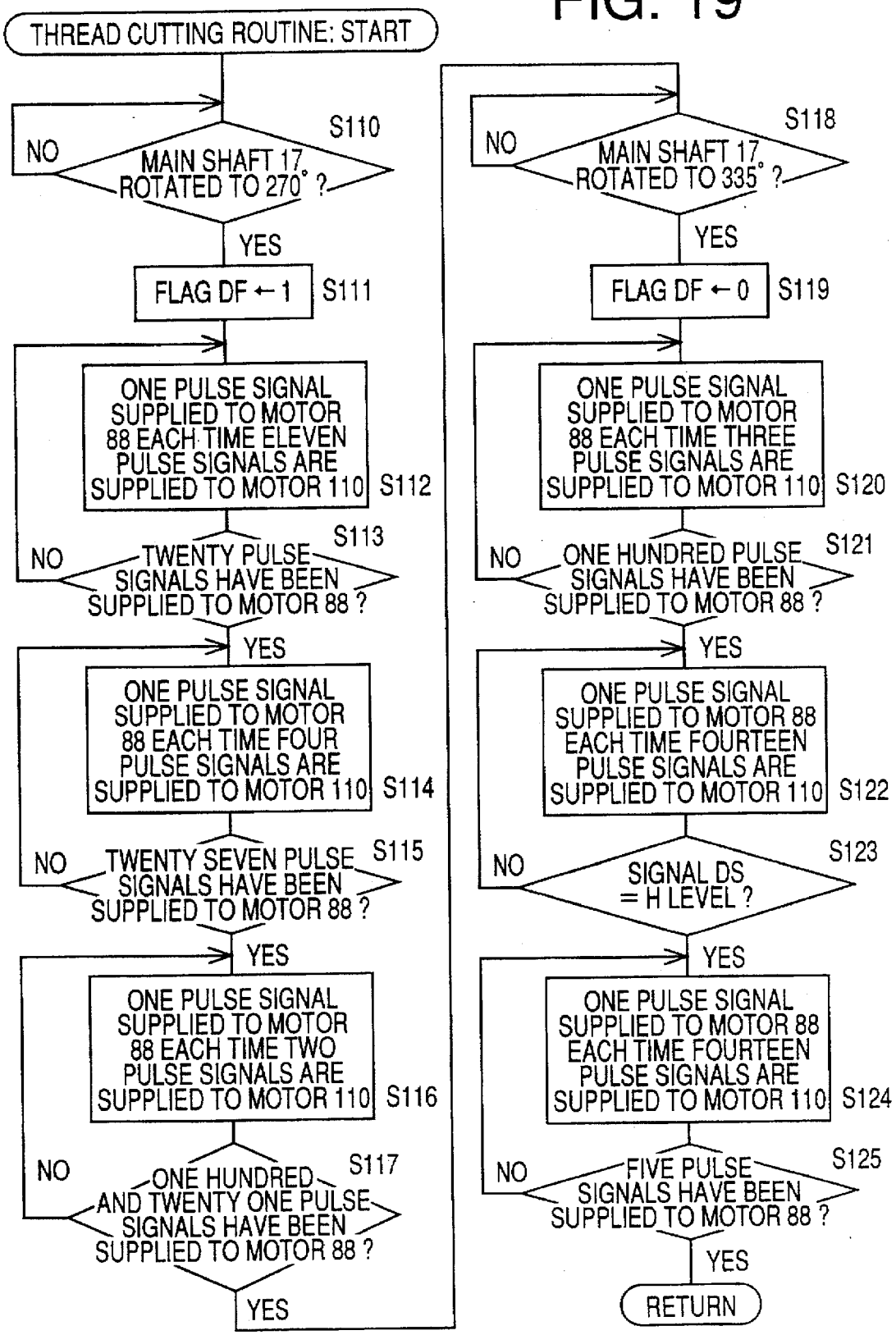
FIG. 19 is a flow chart representing a thread cutting routine.

Referring next to FIG. 19, there will be described the thread cutting routine which is carried out by the catcher-shaft control device 150 concurrently with the above-described needle-thread-amount securing routine.

Figure 18:
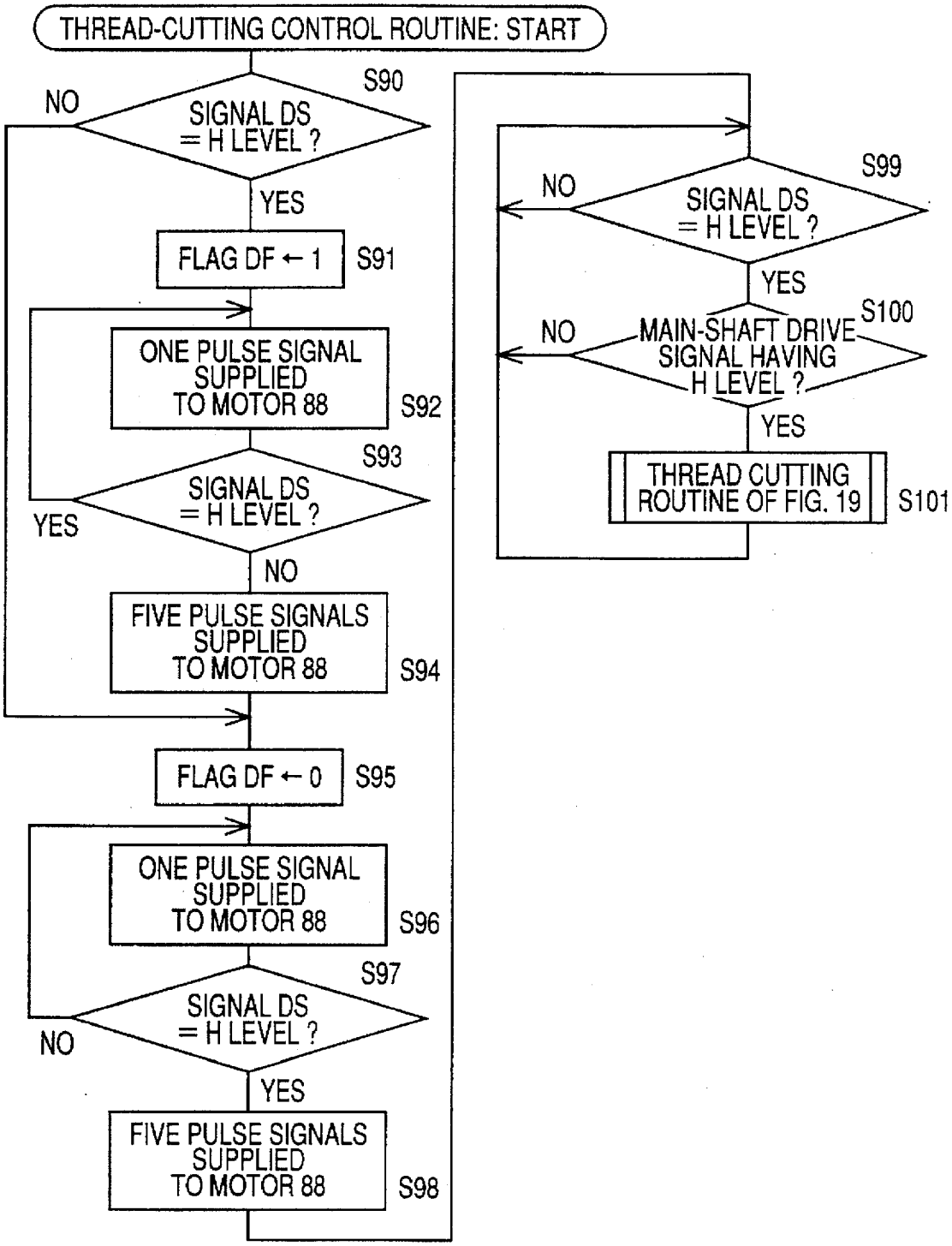
FIG. 18 is a flow chart representing a thread-cutting control routine.

The thread cutting routine, shown in FIG. 19, is employed in a thread-cutting control routine, shown in FIG. 18, which is carried out by the catcher-shaft control device 150, concurrently with the catcher-shaft control routine of FIG. 10, upon application of an electric power to the present machine M. Hence, first, the thread-cutting control routine will be described in detail.

Upon application of an electric power to the machine M, the control device 150 begins with the routine of FIG. 18. First, at Steps S90 to S98, the movable blade 81 is initialized. More specifically described, the CPU 151 judges whether the control device 150 is receiving, from the position sensor 94, the position detection signal DS having the H level, that is, whether the sensor 94 is detecting the shading plate 95 when the movable blade 81 is positioned near the retracted position. If a positive judgment is made at Step S90, the control goes to Step S91 to set a rotation-direction flag, DF, to "1" indicating that the thread cutting motor 88 is to be rotated in a direction in which to rotate the movable blade 81 from the retracted position to the advanced position. Step S91 is followed by Step S92 to supply one drive pulse signal to the motor 88 to rotate or move the blade 81 from the retracted position. Subsequently, at Step S93, the CPU 151 judges whether the control device 150 is receiving the position detection signal DS having the H level. If a positive judgment is made at Step S93, that is, if the blade 81 has not been rotated by a predetermined amount from the retracted position, Steps S92 and S93 are repeated.

If a negative judgment is made at Step S93, that is, if the control device 150 has first received the position detection signal DS having the L level, the control of the CPU 151 goes to Step S94 to supply five drive pulse signals to the thread cutting motor 88 so as to rotate the movable blade 81 by a predetermined small angle in the advancing direction. Step S94 is followed by Step S95 to set the rotation-direction flag to "0" indicating that the blade 81 is to be rotated in the retracting direction. Subsequently, at Step S96, the CPU 151 supplies one drive pulse signal to the motor 88 to rotate the blade 81 toward the retracted position. Subsequently, at Step S97, the CPU 151 judges whether the control device 150 has first received the position detection signal DS having the H level. If a negative judgment is made at Step S97, Steps S96 and S97 are repeated. Meanwhile, if a positive judgment is made at Step S97, the control of the CPU 151 goes to Step S98 to supply five drive pulse signals to the thread cutting motor 88 so as to rotate the movable blade 81 by a predetermined small angle in the retracting direction.

Step S98 is followed by Step S99 to judge whether the main control device 100 is supplying the main-shaft drive signal having the H level to the main motor 110. If a positive judgment is made at Step S98, the control goes to Step S100 to judge whether the catcher-shaft control device 150 has received, from the main control device, a thread cutting signal to command the control device 150 to carry out the thread cutting routine of FIG. 19. If a negative judgment is made at Step S100, Steps S99 and S100 are repeated. Assuming that the main control device 100 supplies the thread cutting signal when the main shaft 17 is rotated to 260° during the formation of the N-th stitch, as shown in FIG. 20, a positive judgment is made at Step S100. Thus, the control of the CPU 151 goes to Step S101, i.e., the thread cutting routine of FIG. 19.

First, at Step S110, the CPU 151 judges whether the main shaft 17 has been rotated to 270° following the commencement of this routine. If a positive judgment is made at Step S110, the control of the CPU 151 goes to Step S111 to set the rotation-direction flag DF to "1". Then, the control goes to Step S112 to count the number of pulse signals which are supplied from the main control device 100 to the main motor 110 and, if the counted number increases up to eleven, supply one pulse signal to the thread cutting motor 88. Step S112 is followed by Step S113 to judge whether the operation of Step S112 has been repeated twenty times. If a negative judgment is made at Step S113, Steps S112 and S113 are repeated.

Meanwhile, if a positive judgment is made at Step S113, the control goes to Step S114 to count the number of pulse signals supplied from the control device 100 to the main motor 110 and, if the counted number increases up to four, supply one pulse signal to the thread cutting motor 88. Step S114 is followed by Step S115 to judge whether the operation of Step S114 has been repeated twenty seven times. If a negative judgment is made at Step S115, Steps S114 and S115 are repeated.

Figure 27:
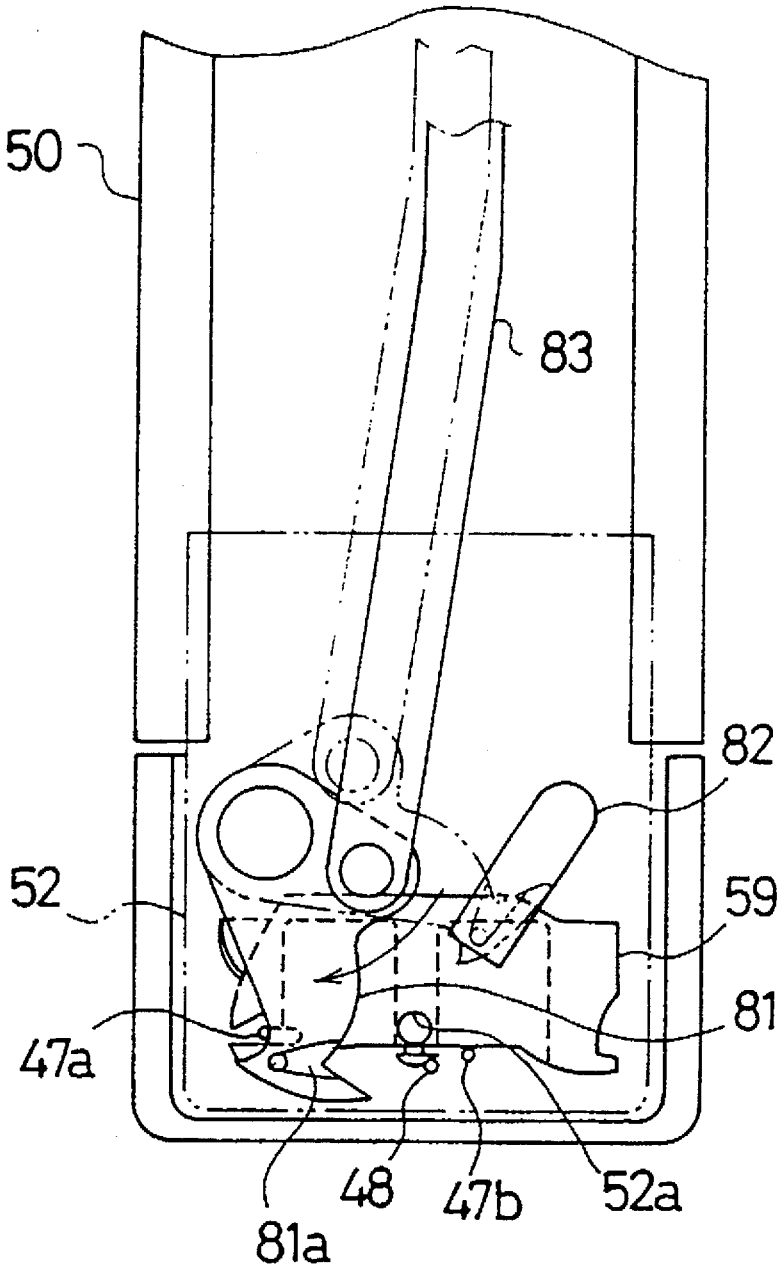
FIG. 27 is a view corresponding to FIG. 6, showing a manner in which a movable blade is rotated from its retracted position to its advanced (maximum rotation) position.

Meanwhile, if a positive judgment is made at Step S115, the control goes to Step S116 to count the number of pulse signals supplied from the control device 100 to the main motor 110 and, if the two signals are counted, supply one pulse signal to the thread cutting motor 88. Step S116 is followed by Step S117 to judge whether the operation of Step S116 has been repeated one hundred and twenty one times. If a negative judgment is made at Step S117, Steps S116 and S117 are repeated. As shown in FIG. 27, when the 121 pulse signals are supplied to the thread cutting motor 88 at Steps S116 and S117, the movable blade 81 separates a first portion 47*a* of the needle thread 47 on the side of the sewing needle 22, from a second portion 47*b* of the same 47 on the side of the work sheet W and the bobbin thread 48, after the loop 47*c* of the needle thread 47 has been released from a bifurcated, thread guiding portion 59*c* which is opposite to the point-of-hook 59*b* on the rotating hook 59*a* of the loop catcher 59.

FIG. 27 shows the advanced (maximum rotation) position of the movable blade 81 after the thread cutting motor 88 has been rotated in response to the 121 pulse signals. When the blade 81 is rotated back from the advanced position, the blade 81 is engageable with the bobbin thread 48 and the second portion 47*b* of the needle thread 47 on the side of the work sheet W.

Figure 26:
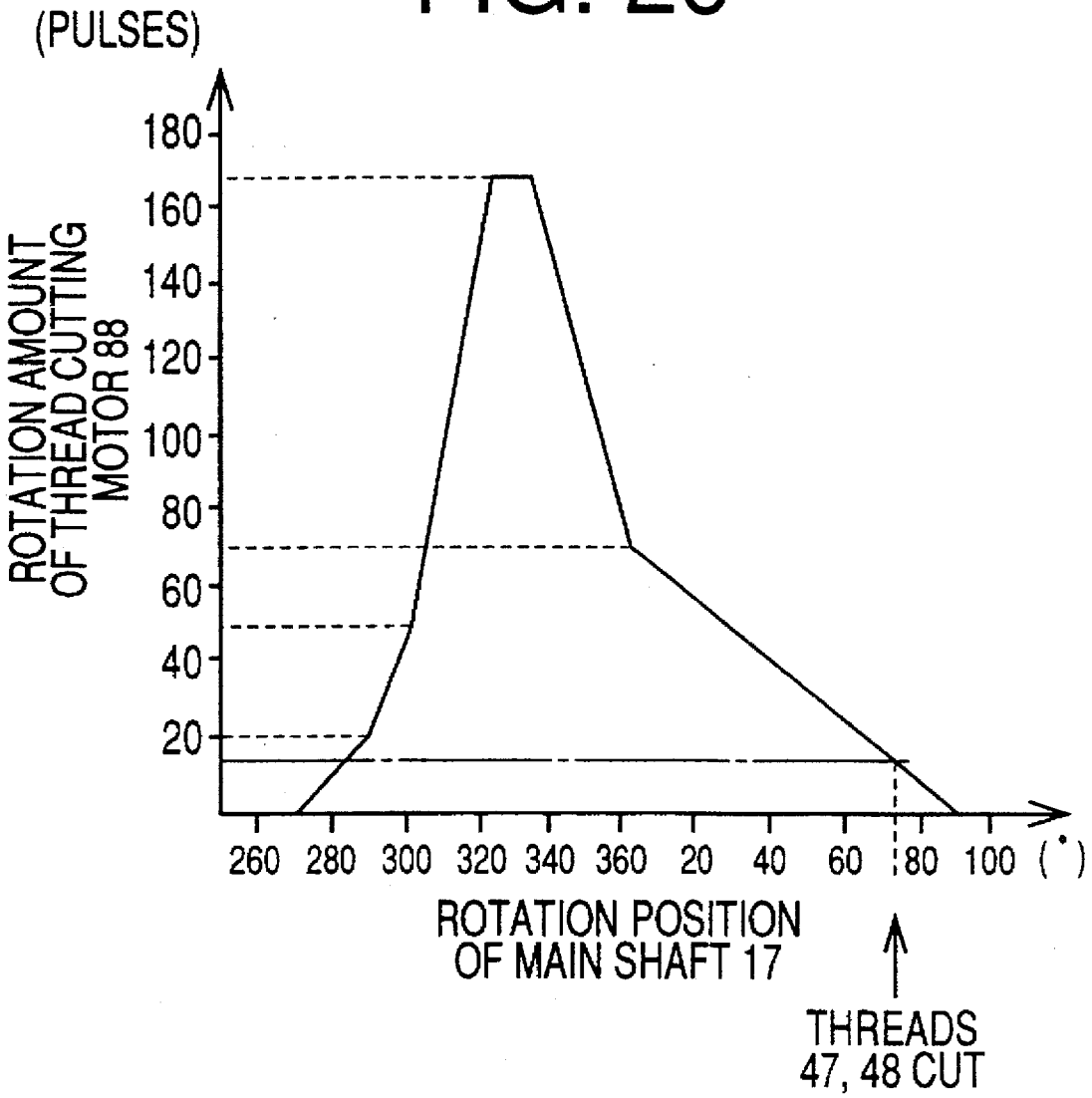
FIG. 26 is a graph illustrating the amount of operation (rotation) of a thread cutting motor, in comparison with the rotation position of the main shaft.
Figure 28:
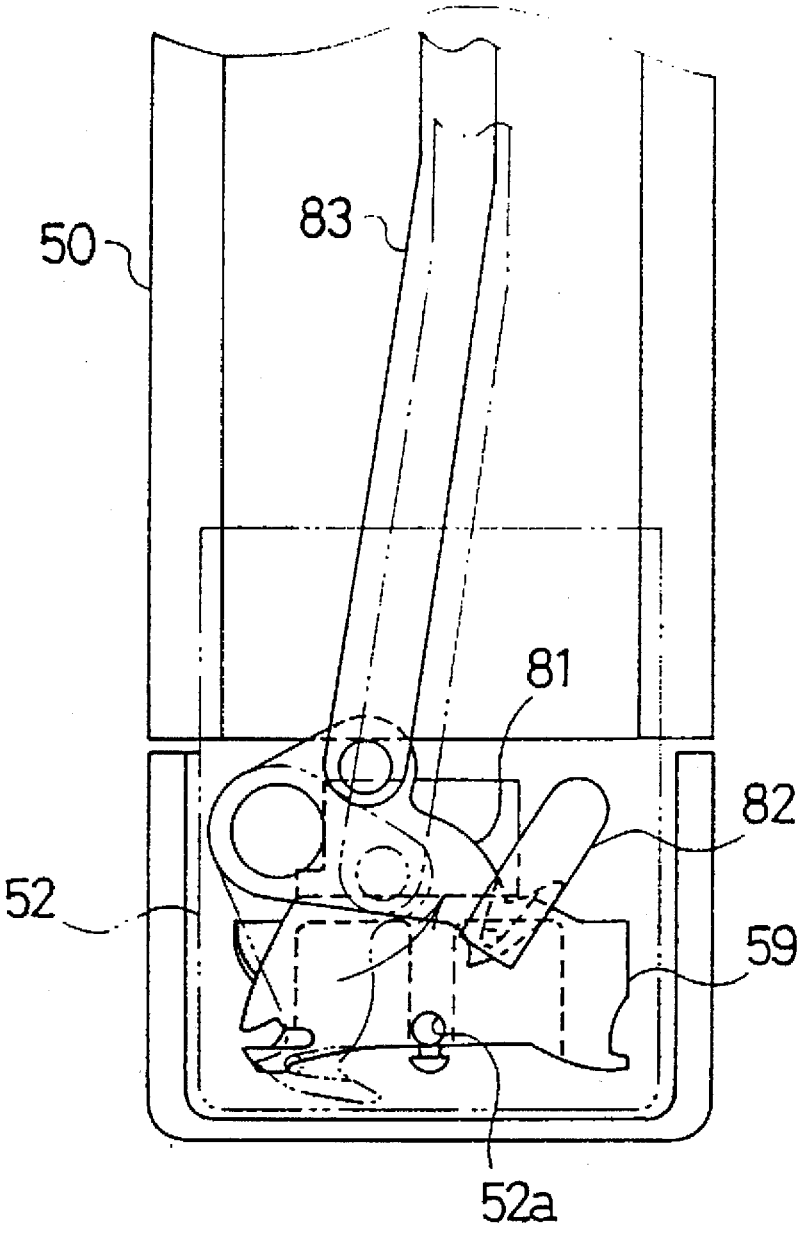
FIG. 28 is a view corresponding to FIG. 6, showing a manner in which the movable blade is rotated from its advanced (maximum rotation) position to its retracted position so that the movable blade engages a needle thread and a bobbin thread and cooperates with a stationary blade to cut the two threads simultaneously.

If a positive judgment is made at Step S117, the control of the CPU 151 goes to Step S118 to stop, as shown in FIG. 26, the operation of the thread cutting motor 88, thereby stopping the rotation of the movable blade 81, and judge whether the main shaft 17 has been rotated to 335° at which the rotation of the loop-catcher shaft 60 at the high speeds proportional to the rotation speed of the main shaft 17 is started. If a positive judgment is made at Step S118, the control goes to Step S119 to reset the rotation-direction flag to "0" so as to rotate the blade 81 in the retracting direction and then to Step S120 to count the number of pulse signals supplied from the control device 100 to the main motor 110 and, if the counted number increases up to three, supply one pulse signal to the thread cutting motor 88. Step S120 is followed by Step S121 to judge whether the operation of Step S120 has been repeated one hundred times. If a negative judgment is made at Step S120, Steps S120 and S121 are repeated. While Steps S120 and S121 are repeated, the notch 81*a* of the blade 81 engages the bobbin thread 48 and the second portion 47*b* of the needle thread 47 on the side of the work sheet W.

if a positive judgment is made at Step S121, the control of the CPU 151 goes to Step S122 to count the number of pulse signals supplied from the control device 100 to the main motor 110 and, if the counted number increases up to fourteen, supply one pulse signal to the thread cutting motor 88. Step S122 is followed by Step S123 to judge whether the control device 150 has received the position signal DS having the H level. If a negative judgment is made at Step S123, Steps S122 and S123 are repeated. As indicated in solid line in FIG. 28, at the end of the repetition of Steps S120 and S121, the movable blade 81 cooperates with the stationary blade 82 to cut simultaneously the needle and bobbin threads 47, 48. If a positive judgment is made at Step S123, the control goes to Step S124 to count the number of pulse signals supplied from the control device 100 to the main motor 110 and, if the counted number increases up to fourteen, supply one pulse signal to the thread cutting motor 88. Step S124 is followed by Step S125 to judge whether the operation of Step S124 has been repeated five times. If a negative judgment is made at Step S125, Steps S124 and S125 are repeated. Thus, the blade 81 is rotated by a predetermined small angle in the retracting direction.

A positive judgment made at Step S125 indicates that the movable blade 81 has been returned to the retracted position. Thus, the control of the CPU 151 quits this routine and goes to Step S99 of FIG. 18 to wait for the control device 150 to receive a thread cutting command from the main control device 100. In this situation, the cut ends of the needle thread 47 and the bobbin thread 48 on the side of the work sheet W are held by a thread holding device (not show) provided below the stationary blade 82.

The needle and bobbin threads 47, 48 are cut after the loop 47*c* of the needle thread 47 has been released from the loop catcher 59. The thread loop 47*c* is quickly released from the catcher 59 at the timing when the main shaft 17 is positioned at a predetermined rotation position while the loop-catcher shaft 60 is rotated at the high speeds proportional to the rotation speed of the main shaft 17. Thus, the thread loop 47*c* is released at a highly accurate timing and accordingly an accurate amount of the needle thread 47 is secured after the thread cutting operation. The thus secured amount of the needle thread 47 is so long that the cut, free end portion of the thread 47 is effectively prevented from coming off the eye hole of the sewing needle 22 when the next sewing operation is started.

Next, there will be described the operation of the multiple-head embroidering machine M, constructed as described above, for treating an abnormal state, i.e., an asynchronous state identified during a sewing operation.

When the catcher-shaft control device 150 operates according to the catcher-shaft synchronizing routine of FIG. 14 while an embroidery including N stitches is formed one stitch by one on the work sheet W, the control device 150 may not receive, at Steps S44 and S45, any catcher-shaft rotation signal from the second encoder sensor 65 although drive pulse signals are supplied to the loop-catcher drive motor 58, or may identify, at Step S50, that the amount of asynchronism between the main shaft 17 and the loop-catcher shaft 60 is greater than a reference permissible amount. In each case, the control device 150 operates, at Step S51, for forcibly jumping the needle bar 21 to which the sewing needle 22 is secured, up to the upper-dead position thereof. Thus, the needle 22 is effectively prevented from colliding with the loop catcher 59 in the first asynchronous state in which the amount of asynchronism between the main shaft 17 and the loop-catcher shaft 60 is greater than the reference amount or in the second asynchronous state in which it is expected from the judgment obtained at Step S45 that the amount of asynchronism will be greater than the reference amount.

In addition, the control device 150 may identify, at Step S49, that the detected voltage $V_K$ is lower than a reference low voltage $V_s$ at which the main motor 110 and/or the catcher-shaft drive motor 58 cannot normally operate. In this case, too, the control device 150 operates, at Step S51, for forcibly jumping the needle bar 21 up to the upper-dead position thereof. Thus, the sewing needle 22 is effectively prevented from colliding with the loop catcher 59 in the asynchronous state in which it is expected from the excessive voltage fall that the amount of asynchronism will be greater than the reference amount.

Figure 11:
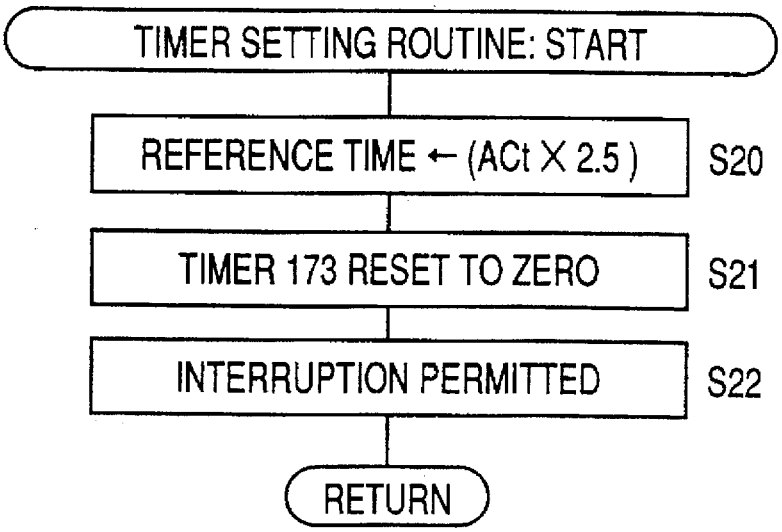
FIG. 11 is a flow chart representing a reference-time setting routine.

Moreover, the control device 150 may identify, from the control-interruption signal supplied thereto from the timer 173 at Step S22 of FIG. 11, that the electric-power supplying service has interrupted. In this case, too, the control device 150 operates, at Step S51, for forcibly jumping the needle bar 21 up to the upper-dead position thereof. Thus, the sewing needle 22 is effectively prevented from colliding with the loop catcher 59 in the asynchronous state in which it is expected from the interruption of the electric-power supplying service that the amount of asynchronism will be greater than the reference amount.

Furthermore, in order to jump up the needle bar 21 in each asynchronous state, the capacitor C quickly supplies the stored electricity to the needle-bar jumping solenoid 41 via the driver circuit 105, the solenoid 41 quickly and reliably operates for jumping up the bar 21.

While the present invention has been described in its preferred embodiment, it is to be understood that the the invention may otherwise be embodied.

For example, although in the illustrated embodiment the rotation of the loop-catcher shaft 60 is synchronized with the rotation of the main shaft 17, it is possible to synchronize the rotation of the main shaft 17 with the rotation of the loop-catcher shaft 60.

In addition, the main control device 100 and the catcher-shaft control device 150 may be modified such that only one of the two motors 100, 150 generates a series of synchronizing pulse signals which are commonly utilized by the main motor 100 and the catcher-shaft drive motor 58 so that the two motors 110, 58 are synchronized with each other.

Moreover, the service-interruption detector circuit 170 and/or the voltage-fall detector circuit 180 may be replaced by combining other kinds of electronic components and/or circuits.

The capacitor C may be incorporated into the driver circuit 105 which is provided for driving the needle-bar jumping solenoid 41.

The solenoid 41 may be adapted to be energized by a regenerative electric current which is generated when the main motor 110 and/or the catcher-shaft drive motor 58 are rotated due to their inertias.

The solenoid 41 may be modified such that it permits the needle bar 21 to jump up when it is deenergized due to the interruption of the electric-power supplying service.

The main motor 110 may be provided by various kinds of electric motors such as a stepper motor or an AC servomotor other than the inductor motor employed in the illustrated embodiment, and the catcher-shaft drive motor 58 may be provided by various kinds of electric motors such as an inductor motor or an AC servomotor other than the stepper motor employed in the illustrated embodiment.

The principle of the present invention may be applicable to various kinds of sewing machines, such as a single-head sewing machine, in which a loop catcher is driven independent of a main shaft.

It is to be understood that the present invention may be embodied with other changes, improvements, and modifications that may occur to those skilled in the art without departing from the spirit and scope of the invention defined in the appended claims.

What is claimed is:

1. A sewing machine comprising:

a needle bar for holding a sewing needle which conveys a sewing thread;

a shaft member to which said needle bar is connected;

a needle-bar drive motor which reciprocates said needle bar via said shaft member;

a loop catcher which cooperates with said sewing needle to catch a loop of the sewing thread conveyed by the sewing needle;

a catcher drive motor which rotates said loop catcher;

an asynchronism detector which detects at least one of (a) a first asynchronous state in which an amount of asynchronism between said needle bar and said loop catcher is greater than a first reference value and (b) a second asynchronous state in which it is expected that said amount of asynchronism will be greater than a second reference value; and a holding device which holds, when said asynchronism detector detects said at least one of said first and second asynchronous states, at least one of said needle bar and said loop catcher, at a holding position where said sewing needle and the loop catcher do not collide with each other.

2. A sewing machine according to claim 1, wherein said asynchronism detector comprises a first asynchronous state detector which detects said first asynchronous state.

3. A sewing machine according to claim 2, wherein said first asynchronous state detector comprises a phase difference depending detector which obtains, as said amount of asynchronism, a phase difference between a nominal phase of one of said needle bar and said loop catcher which corresponds to a reference phase of the other of the needle bar and the catcher and an actual phase of said one of the needle bar and the catcher when said other of the needle and the catcher actually takes said reference phase, and which detects said first asynchronous state when said phase difference is greater than said first reference value.

4. A sewing machine according to claim 3, wherein said phase difference depending detector comprises a reference phase detector which detects said reference phase of said other of said needle bar and said loop catcher, and an actual phase detector which detects said actual phase of said one of the needle bar and the catcher when said reference phase detector detects said reference phase of said other of the needle bar and the catcher.

5. A sewing machine according to claim 4, wherein said phase difference depending detector comprises:

said actual phase detector comprising a rotation amount detector which detects, as said actual phase, an amount of rotation of said shaft member from a first predetermined phase thereof during a time period in which said loop catcher is actually rotated from a second predetermined phase thereof corresponding to said first predetermined phase of the shaft member, to a third predetermined phase as said reference phase;

calculating means for calculating, based on said amount of rotation of said shaft member, an actual command signal number representing a number of command signals which are actually supplied to a stepper motor as said catcher drive motor in said time period, each of said command signals being supplied to said stepper motor to rotate the shaft member by a predetermined amount; and judging means for judging whether a difference between said actual command signal number and a nominal command signal number representing, as said nominal phase, a number of command signals which are nominally supplied to said stepper motor while said loop catcher is rotated from said second predetermined phase to said third predetermined phase, is greater than a reference command signal number representing said first reference value.

6. A sewing machine according to claim 5, wherein said phase difference depending detector further comprises a memory in which said nominal command signal number and said reference command signal number are stored.

7. A sewing machine according to claim 1, wherein said asynchronism detector comprises a second asynchronous state detector which detects said second asynchronous state.

8. A sewing machine according to claim 7, wherein said second asynchronous state detector comprises:

a commanding device which supplies a command signal to a stepper motor as said catcher drive motor to rotate said stepper motor and said loop catcher;

a catcher rotation detector which detects the rotation of said loop catcher by said stepper motor in response to the command signal supplied thereto from said commanding device;

a command signal counter which counts a number of command signals which are actually supplied from said commanding device to said stepper motor; and judging means for judging that said amount of asynchronism will be greater than said second reference value, when said catcher rotation detector does not detect more than a predetermined amount of rotation of said loop catcher by said stepper motor in response to said number of command signals supplied thereto from said commanding device.

9. A sewing machine according to claim 8, wherein said judging means comprises means for judging that said amount of asynchronism will be greater than said second reference value, when said catcher rotation detector does not detect any amount of rotation of said loop catcher in response to said number of command signals supplied thereto from said commanding device.

10. A sewing machine according to claim 7, wherein said second asynchronous state detector comprises a voltage fall detector which detects that an electric voltage which is supplied to at least one of said needle-bar drive motor and said catcher drive motor has fallen to a value at which said at least one of the needle-bar drive motor and the catcher drive motor does not normally operate.

11. A sewing machine according to claim 7, wherein said second asynchronous state detector comprises a service-interruption detector which detects that a service of electricity to at least one of said needle-bar drive motor and said catcher drive motor has been interrupted.

12. A sewing machine according to claim 1, further comprising a control device which operates, when said asynchronism detector detects said at least one of said first and second asynchronous states, said holding device to hold said one of said sewing needle and said loop catcher at said holding position.

13. A sewing machine according to claim 1, wherein said holding device comprises a needle-bar holding device which holds said sewing needle at said holding position wherein said sewing needle does not collide with said loop catcher.

14. A sewing machine according to claim 13, wherein said needle-bar holding device comprises a needle-bar jumping mechanism comprising a biasing member which provides a biasing force to bias said needle bar toward an upper dead position thereof, and a needle-bar disconnecting device which disconnects said needle bar from said shaft member and permits the needle bar to jump up to said upper dead position thereof because of the biasing force of said biasing member.

15. A sewing machine according to claim 14, wherein said disconnecting device comprises an axis member which extends in a direction in which said needle bar is reciprocated, a drive member which is supported by said axis member such that said drive member is movable relative to the axis member in an axial direction thereof and is rotatable about the axis member relative thereto, an engageable member which is provided on said needle bar and is engageable with said drive member, a biasing member which provides a biasing force to bias said drive member and thereby rotate the drive member toward an engageable rotation position in which the drive member is engageable with said engageable member, and a connection member which is connected to said shaft member such that said connection member is moved relative to said axis member in said axial direction thereof, by said needle-bar drive motor via the shaft member, and which is connected to said drive member such that the drive member is movable with said connection member in said axial direction of said axis member and is rotatable about said axis member relative to the connection member.

16. A sewing machine according to claim 15, wherein said needle-bar jumping mechanism further comprises an actuator which rotates said drive member from said engageable rotation position in which said drive member is engaged with said engageable member provided on said needle bar, to a non-engageable rotation position in which the drive member is not engageable with the engageable portion, so that the needle bar jumps up to said upper dead position thereof because of said biasing force of said biasing member.

17. A sewing machine according to claim 16, wherein said drive member has an inclined upper surface and an engageable recess, and wherein when said drive member being held in said engageable rotation position is moved up to a position corresponding to said upper dead position of said needle bar, by said needle-bar drive motor via said shaft member and said connection member, the drive member is rotated from the engageable position toward said non-engageable rotation position, against the biasing force of said biasing member, because said inclined surface of the drive member is engaged with said engageable member provided on said needle bar, and, when said drive member reaches said position corresponding to said upper dead position of the needle bar, said engageable recess is permitted to engage the engageable member and the drive member is rotated, because of the biasing force of said biasing member, from the non-engageable position to the engageable position in which the engageable recess of the drive member is engaged with the engageable member.

18. A sewing machine according to claim 15, further comprising a converting mechanism which converts the rotation of said shaft member by said needle-bar drive motor, into the movement of said connection member and said drive member relative to said axis member in said axial direction thereof.

19. A sewing machine according to claim 1, further comprising an electric source, wherein said holding device comprises an electrically-operated actuator which is, when said asynchronism detector detects said at least one of said first and second asynchronous states, supplied with electricity from said electric source so as to hold said one of said needle bar and said loop catcher at said holding position.

20. A sewing machine according to claim 19, wherein said electric source comprises a capacitor which stores said electricity.

* * * * *